US010315322B1

(12) United States Patent
Dryfhout

(10) Patent No.: US 10,315,322 B1
(45) Date of Patent: Jun. 11, 2019

(54) METHOD OF USING A BACK SHAVER HANDLE

(71) Applicant: Dryfhout Enterprises, LLC, Frankfort, IL (US)

(72) Inventor: Matthew James Dryfhout, Frankfort, IL (US)

(73) Assignee: Dryfhout Properties, LLC, Chicago, IL (US)

( * ) Notice: Subject to any disclaimer, the term of this patent is extended or adjusted under 35 U.S.C. 154(b) by 45 days.

(21) Appl. No.: 15/156,816

(22) Filed: May 17, 2016

(51) Int. Cl.
*B26B 21/40* (2006.01)
*B26B 21/52* (2006.01)
*A45D 27/04* (2006.01)

(52) U.S. Cl.
CPC ..... *B26B 21/4081* (2013.01); *A45D 27/04* (2013.01); *B26B 21/4031* (2013.01); *B26B 21/522* (2013.01); *B26B 21/523* (2013.01)

(58) Field of Classification Search
CPC ..... B26B 21/52–21/527
USPC ..... D28/44–48; 30/47–51, 526–537
See application file for complete search history.

(56) References Cited

U.S. PATENT DOCUMENTS

| | | | |
|---|---|---|---|
| 65,130 | A | 5/1867 | Spblman |
| 775,134 | A | 11/1904 | Gillette |
| 913,005 | A | 2/1909 | Lancellotte |
| 974,083 | A | 10/1910 | Likewise |
| 991,147 | A | 5/1911 | Gillette |
| 1,047,617 | A | 12/1912 | Cress |
| 1,060,245 | A | 4/1913 | Gaisman |
| 1,111,721 | A | 9/1914 | Gillette |
| 1,158,480 | A | 11/1915 | Gillette |
| 1,158,481 | A | 11/1915 | Gillette |
| 1,288,522 | A | 12/1918 | Cowan |
| 1,383,516 | A | 7/1921 | Benton |
| 1,386,353 | A | 8/1921 | Norton |
| D59,243 | S | 10/1921 | MacLagan |
| 1,419,187 | A | 6/1922 | Wilson |

(Continued)

FOREIGN PATENT DOCUMENTS

| | | | | |
|---|---|---|---|---|
| CA | 2936645 | A1 * | 8/2015 | ..... B26B 21/4081 |
| CN | 2329495 | Y | 7/1999 | |

(Continued)

OTHER PUBLICATIONS

Shave from www.ishave.com downloaded Jun. 24, 2008.

(Continued)

*Primary Examiner* — Jason Daniel Prone
(74) *Attorney, Agent, or Firm* — Patents and Licensing LLC; Daniel W Juffernbruch

(57) ABSTRACT

A back shaver handle has a generally s-shaped elongated member. A grip has a finger surface located on the inner side. A blade attachment at a blade end is located on the inner side. A body leverage surface is located on an outer side of the elongated member near a midway between the grip and the blade end configured to press a body leverage surface against a user's forearm when a finger surface and grip are respectively gripped by fingers and hand with thumb facing away from the blade end of a same arm of the user and the s-shaped elongated member is reaching the blade end under an armpit of the same arm of the user to leverage the blade attachment located on the inner side of the elongated member towards a torso backside of the user.

17 Claims, 28 Drawing Sheets

(56) References Cited

U.S. PATENT DOCUMENTS 1,477,689 A 12/1923 Burns
1,572,154 A 2/1926 McConoughey
1,749,051 A * 3/1930 Watt ..... B26B 21/523 30/526
1,789,234 A 1/1931 Keenan
1,876,570 A * 9/1932 Cesario ..... B26B 21/00 30/526
1,899,414 A 2/1933 Gray
1,976,987 A * 10/1934 Gardner et al. ..... B26B 21/16 30/51
2,108,267 A 2/1938 O'Neil
2,151,265 A 3/1939 Clausen
2,165,391 A 7/1939 Lewis
2,168,447 A * 8/1939 Patterson ..... B26B 21/16 30/526
2,171,880 A 9/1939 Lewis
2,198,531 A 4/1940 Fulenwider
D123,180 S 10/1940 Pileggi
D124,684 S 1/1941 Werner
2,229,971 A 1/1941 Hammerling
2,234,440 A 3/1941 Lewis
2,237,676 A 4/1941 Lewis
2,325,868 A 5/1941 Morrow
2,252,628 A 8/1941 Grachan
2,256,326 A 9/1941 Quinio
2,270,388 A 1/1942 Stampleman
2,288,299 A 6/1942 Pileggi
2,363,894 A 11/1944 Muros
2,370,815 A * 3/1945 Ross ..... B26B 21/18 30/526
D150,189 S 7/1948 Zurlinden
D154,784 S 8/1949 Lazar
2,488,436 A 11/1949 Santoro, Sr.
D157,063 S 1/1950 Mansfield
D157,064 S 1/1950 Mansfield
D159,994 S 9/1950 Lee
D161,784 S 1/1951 Palmer
2,536,485 A 1/1951 Behr
2,568,368 A 9/1951 Sayer et al.
2,580,058 A * 12/1951 Willhelm ..... B26B 21/16 30/526
2,587,964 A 3/1952 Burns
RE23,505 E 5/1952 Davis
2,615,243 A 10/1952 Brown
2,615,244 A 10/1952 Mansfield
D169,147 S * 3/1953 Lamb ..... D28/48
2,633,635 A 4/1953 North
2,641,055 A 6/1953 Mansfield
2,661,529 A 12/1953 Infantino
2,663,930 A 12/1953 Di Zazzo
2,670,533 A 3/1954 Kearney
2,703,449 A * 3/1955 Haynes ..... B26B 21/10 30/526
2,725,886 A 12/1955 Gagliano
2,746,144 A 5/1956 Spanel
2,766,521 A 10/1956 Benvenuti
2,810,953 A * 10/1957 Brody ..... B26B 21/12 30/526
2,814,865 A 12/1957 Sunich
2,834,357 A 5/1958 Gould
2,840,901 A 7/1958 Narizzano
2,858,835 A 11/1958 Parziale
2,866,984 A 1/1959 Plough
2,869,229 A 1/1959 Hightower
2,896,320 A 7/1959 Caplan
2,900,718 A 8/1959 Bailey
2,952,907 A 9/1960 Miller
2,959,853 A 11/1960 Mercer
2,967,354 A 1/1961 Ahlborn
2,972,187 A 2/1961 Gore
D190,580 S 6/1961 Christensen
3,041,721 A 7/1962 Quinio, Sr.
3,054,180 A 9/1962 Gore
3,084,430 A 4/1963 Pacitti
D195,954 S 8/1963 Christensen
3,106,020 A 10/1963 Tape
D197,588 S 2/1964 Macon
3,138,865 A 6/1964 Meyer
3,238,616 A 3/1966 Eweson
3,259,978 A 7/1966 Weichselbaum
D205,453 S 8/1966 Christensen
D208,619 S * 9/1967 Baker et al. ..... D28/46
3,358,367 A 12/1967 Bartley
3,384,960 A 5/1968 Solomon
D211,443 S 6/1968 Tin
3,402,467 A 9/1968 Manahan
3,413,720 A 12/1968 Mullen
3,421,213 A 1/1969 Pawlikowski
3,500,539 A 3/1970 Muros
3,536,080 A 10/1970 Player
D219,501 S 12/1970 Trevor
3,570,121 A 3/1971 Graceffo
3,571,927 A * 3/1971 Stone ..... B26B 21/06 30/526
3,599,327 A 8/1971 Calandra
3,644,992 A 2/1972 Bennett et al.
3,646,672 A 3/1972 Braginetz
3,675,323 A 7/1972 Braginetz
3,768,161 A 10/1973 Miller
3,805,381 A 4/1974 Broussard
3,816,912 A 6/1974 Glaberson
3,816,913 A 6/1974 Ferraro
D232,874 S 9/1974 Koblick
3,834,017 A 9/1974 Tolmie
D235,696 S * 7/1975 Krupski ..... D28/48
3,895,437 A 7/1975 DiBuono
3,969,817 A 7/1976 DiBuono
3,986,258 A 10/1976 Liedtke
4,009,517 A 3/1977 Horn
4,011,656 A 3/1977 Liedtke
4,020,549 A 5/1977 Edwards
4,026,016 A 5/1977 Nissen
4,069,580 A 1/1978 Cartwright et al.
4,074,429 A 2/1978 Roberts
4,094,066 A 6/1978 Daniel, Jr.
4,163,316 A 8/1979 Hagmann et al.
4,198,746 A 4/1980 Trotta
D259,743 S * 6/1981 Hollinger ..... D28/46
4,281,456 A 8/1981 Douglass et al.
RE30,913 E 4/1982 Cartwright et al.
4,335,509 A * 6/1982 Smith ..... B26B 21/28 30/48
4,344,226 A 8/1982 Blake, III
4,346,721 A 8/1982 Molaro
4,378,633 A 4/1983 Jacobson
4,401,129 A 8/1983 Luque
4,409,735 A 10/1983 Cartwright et al.
4,441,252 A 4/1984 Caves
4,446,619 A 5/1984 Jacobson
4,461,078 A * 7/1984 Carreker ..... B26B 21/40 30/526
4,501,066 A 2/1985 Sceberras
4,512,077 A 4/1985 Tanabe et al.
4,562,644 A 1/1986 Hitchens
4,599,793 A 7/1986 Iten
4,663,841 A 5/1987 Custer
4,692,986 A 9/1987 Motta
4,709,475 A 12/1987 Phung
4,712,300 A * 12/1987 Hemmeter ..... B26B 21/44 30/537
4,741,103 A 5/1988 Hultman
4,768,528 A * 9/1988 Steele, Jr. ..... A45D 24/36 D28/44.2
4,831,731 A 5/1989 Elits
4,850,107 A 7/1989 Valliades
4,893,641 A * 1/1990 Strickland ..... B26B 21/28 30/49
4,905,372 A 3/1990 Willis
4,912,846 A 4/1990 Yu
4,928,716 A 5/1990 Greene
4,955,136 A * 9/1990 Diaz-Rivera ..... B26B 21/10 30/527
D312,144 S 11/1990 Buba

(56) References Cited

U.S. PATENT DOCUMENTS

D314,247 S * 1/1991 Amit ..... D28/44.1
5,009,003 A * 4/1991 Grange ..... B26B 21/04 30/528
5,010,645 A 4/1991 Furukawa
5,031,316 A 7/1991 Oldroyd
5,031,319 A * 7/1991 Althaus ..... B26B 21/522 30/526
5,129,157 A * 7/1992 Wood ..... B25G 1/102 30/526
5,167,069 A 12/1992 Quinn
5,220,728 A 6/1993 Ueno et al.
5,236,439 A 8/1993 Kozikowski
5,343,622 A 9/1994 Andrews
5,351,356 A 10/1994 Townsend
D352,568 S 11/1994 Meisner
D353,941 S 1/1995 O'Hearn
D354,626 S 1/1995 Hurwitz
D355,049 S * 1/1995 Yasui ..... D28/48
5,386,750 A 2/1995 Morrison
5,388,332 A 2/1995 Oldroyd
5,410,810 A 5/1995 Gillibrand
5,426,853 A 6/1995 McNinch
D364,939 S 12/1995 Scott
5,522,137 A 6/1996 Andrews
5,524,346 A 6/1996 Backhaus
5,526,568 A 6/1996 Copelan
5,560,746 A 10/1996 Willow
5,643,403 A 7/1997 Poole
5,673,711 A 10/1997 Andrews
5,704,127 A 1/1998 Cordio
D391,021 S * 2/1998 van Oene ..... D28/45
5,771,589 A 6/1998 Kim
5,771,591 A * 6/1998 Armbruster ..... B26B 21/52 30/527
5,778,535 A 7/1998 Ledesma
5,787,594 A 8/1998 Estrada
5,802,720 A 9/1998 Pribe
5,802,721 A 9/1998 Wain
5,911,480 A 6/1999 Morgan
5,933,960 A 8/1999 Avidor
5,944,032 A 8/1999 Masterson
6,018,877 A 2/2000 Greene
6,032,372 A 3/2000 Dischler
6,041,503 A 3/2000 Calwell
6,058,608 A 5/2000 Wruck
D428,667 S 7/2000 Christian
6,082,007 A 7/2000 Andrews
6,094,820 A 8/2000 Adachi
6,112,421 A 9/2000 Greene
6,125,857 A * 10/2000 Silber ..... B26B 21/00 30/50
6,141,875 A 11/2000 Andrews
D435,316 S 12/2000 Chenvainu
6,161,288 A 12/2000 Andrews
6,164,290 A 12/2000 Andrews
6,189,222 B1 2/2001 Doyle
6,249,973 B1 6/2001 Hirano
6,266,888 B1 7/2001 Zowaski
6,301,785 B1 10/2001 Kwiecien et al.
6,308,416 B1 10/2001 Bosy
D452,046 S 12/2001 Borcherds
6,418,623 B1 7/2002 Marcarelli
6,434,828 B1 8/2002 Andrews
D463,622 S * 9/2002 Harrington ..... D28/48
6,449,849 B1 * 9/2002 Hackerman ..... B26B 21/14 30/50
6,493,950 B1 12/2002 Kludjian
6,519,856 B1 2/2003 Dischler
D472,673 S * 4/2003 Carvotta ..... D28/44
6,550,148 B2 * 4/2003 Cecil ..... B26B 21/22 30/526
6,581,290 B1 6/2003 Fishel
D476,772 S * 7/2003 Wonderley ..... D28/48
6,598,303 B2 7/2003 Bosy
6,681,665 B2 1/2004 Calwell
6,694,626 B2 2/2004 Kludjian et al.
6,722,039 B2 4/2004 Kitano
D495,827 S 9/2004 Branden
D495,844 S 9/2004 Berti
D496,129 S 9/2004 Ogi
6,823,594 B2 11/2004 Kludjian et al.
D499,511 S * 12/2004 Wakayama ..... D28/46
D500,172 S * 12/2004 Fields ..... D28/46
6,871,403 B2 3/2005 Clark
6,886,262 B2 * 5/2005 Ohtsubo ..... B26B 21/522 30/526
D506,035 S * 6/2005 Dombrowski ..... D28/47
D507,379 S * 7/2005 Alphonso ..... D28/48
6,915,580 B2 * 7/2005 Dassel ..... B26B 21/523 30/526
6,973,730 B2 * 12/2005 Tomassetti ..... B26B 21/225 30/527
7,028,407 B2 4/2006 Ehrlich et al.
7,093,363 B1 * 8/2006 Kuo ..... B26B 21/40 30/535
7,103,980 B2 9/2006 Leventhal
7,140,115 B2 11/2006 Greene
D542,972 S 5/2007 Pryor
D550,400 S 9/2007 Orloff
D560,032 S * 1/2008 Lopez ..... D28/48
7,316,045 B2 1/2008 Koke
D563,044 S 2/2008 Ramm
D585,157 S * 1/2009 Park ..... D28/48
7,475,481 B1 1/2009 Napoli
D587,846 S * 3/2009 Wonderley ..... D28/48
D593,711 S * 6/2009 Yamamoto ..... D28/48
D603,096 S * 10/2009 Greene ..... D28/46
D605,362 S * 12/2009 Andersen ..... D28/48
D611,653 S * 3/2010 Marut ..... D28/46
D611,654 S * 3/2010 Nakasuka ..... D28/48
D611,655 S * 3/2010 Askew ..... D28/48
7,698,823 B1 * 4/2010 Iadarola ..... B26B 21/527 30/537
D616,147 S 5/2010 Adams
7,726,032 B1 6/2010 Hernandez
D621,544 S * 8/2010 Bommarito ..... D28/48
D623,800 S * 9/2010 Clemons ..... D28/46
7,856,725 B2 12/2010 Marut
D630,378 S 1/2011 Jung
D631,198 S 1/2011 Adams
7,926,183 B2 4/2011 Groh
D638,580 S 5/2011 Adams
7,934,320 B2 5/2011 Gratsias et al.
D640,415 S 6/2011 Wonderley
D641,928 S * 7/2011 Psimadas ..... D28/46
8,006,393 B2 7/2011 Collins
8,033,027 B2 10/2011 Leventhal
D653,395 S 1/2012 Adams
8,091,241 B2 1/2012 Ouchi et al.
D654,222 S 2/2012 Coresh
D656,675 S * 3/2012 Payne ..... D28/48
D659,904 S * 5/2012 Gilbert ..... D28/48
8,141,258 B1 5/2012 Frisch et al.
8,166,658 B2 5/2012 Nakasuka
8,166,661 B2 5/2012 King
D664,297 S * 7/2012 Prat-Pfister ..... D28/48
8,209,869 B2 7/2012 Royle
8,307,552 B1 * 11/2012 Drouillard ..... B26B 21/40 30/526
D669,220 S 12/2012 Otsuka
D669,221 S 12/2012 Otsuka
D674,546 S 1/2013 Barrow
D676,197 S * 2/2013 Boulanger ..... D28/48
D678,610 S * 3/2013 Prat-Pfister ..... D28/48
8,413,334 B2 4/2013 Walker, Jr. et al.
8,479,398 B2 7/2013 Coresh
8,484,852 B2 7/2013 King
8,524,207 B2 9/2013 Ellis
8,539,961 B2 9/2013 Gaugler
D698,999 S 2/2014 Otsuka
D699,396 S 2/2014 Hasegawa
D699,893 S * 2/2014 Marut ..... D28/49
D700,997 S * 3/2014 Marut ..... D28/49

(56) References Cited

U.S. PATENT DOCUMENTS 8,671,576 B1 3/2014 Hotella
8,683,641 B2 4/2014 Weinberger
8,701,291 B2 4/2014 Hirano
8,707,561 B1 4/2014 Kneier
8,726,517 B2 5/2014 Lau
8,739,411 B2 6/2014 Kinghorn
8,782,903 B2 7/2014 Clarke et al.
8,782,911 B1 7/2014 Greene
8,839,521 B2 9/2014 Hazard
8,973,272 B2 3/2015 Moon
9,049,976 B2 6/2015 Blocker
9,108,328 B2 8/2015 Kneier
D741,015 S * 10/2015 Sacks ..... D28/48
9,193,080 B2 11/2015 Whelan et al.
9,308,658 B2 * 4/2016 Coviello ..... B26B 21/4081 30/526
9,327,415 B1 * 5/2016 Hovsepian ..... B26B 21/522 30/526
D766,505 S * 9/2016 Coviello ..... D28/46
D772,484 S 11/2016 Otsuka
D773,734 S * 12/2016 Li ..... D28/48
D776,384 S 1/2017 Eldridge
D776,876 S * 1/2017 Coviello ..... D28/48
D777,392 S 1/2017 Reaux
9,604,376 B2 * 3/2017 Sacks ..... B26B 21/523 16/427
D783,900 S * 4/2017 Coviello ..... D28/48
9,630,332 B2 4/2017 Coresh
9,676,112 B2 * 6/2017 Bolcar ..... B26B 21/523 30/526
9,718,200 B2 8/2017 Dryfhout
D798,065 S 9/2017 Brilla
D802,213 S 11/2017 Contaldi
D808,589 S * 1/2018 Dryfhout ..... D28/48
9,937,629 B1 4/2018 Dryfhout
2002/0023352 A1 2/2002 Mil'shtein
2003/0000039 A1 1/2003 Borcherds
2003/0014871 A1 1/2003 Coffin
2003/0177648 A1 9/2003 Zeiter
2003/0204958 A1 * 11/2003 Jewell ..... B26B 21/44 30/538
2003/0208914 A1 11/2003 Ehrlich
2004/0016126 A1 1/2004 deBlois
2004/0035003 A1 * 2/2004 Stiles ..... B26B 21/22 30/50
2004/0107585 A1 6/2004 Helmrich
2004/0128835 A1 7/2004 Coffin
2004/0177518 A1 9/2004 Leventhal
2005/0066532 A1 3/2005 Kludjian
2005/0188554 A1 9/2005 Kjemhus
2005/0198826 A1 9/2005 Segrea
2005/0241162 A1 * 11/2005 Nicolosi ..... B26B 21/225 30/531
2006/0101655 A1 5/2006 Givant
2006/0130334 A1 6/2006 Park
2006/0143926 A1 7/2006 Khubani et al.
2006/0162165 A1 * 7/2006 Villalobos ..... B26B 21/225 30/32
2007/0180700 A9 8/2007 Sandor
2007/0283567 A1 12/2007 Magli
2008/0034525 A1 2/2008 Panfili
2009/0019700 A1 1/2009 Shushan
2009/0032043 A1 2/2009 Gaugler
2009/0255124 A1 * 10/2009 Hasbani ..... B26B 21/225 30/527
2010/0071214 A1 3/2010 Kinghorn
2010/0071215 A1 3/2010 Wonderley
2010/0139097 A1 6/2010 Perez-Lopez
2011/0094108 A1 4/2011 Wain
2011/0094114 A1 4/2011 Payne-Baggetta
2011/0167639 A1 7/2011 Lau
2011/0271534 A1 11/2011 Briganti
2012/0090181 A1 4/2012 Broekhuizen
2012/0110855 A1 5/2012 Allen, Sr.
2012/0151772 A1 6/2012 Moon
2012/0192427 A1 8/2012 Hazard
2012/0192431 A9 8/2012 Wain
2013/0000127 A1 1/2013 Coresh
2013/0019484 A1 * 1/2013 Allen ..... B26B 21/523 30/526
2013/0023807 A1 1/2013 Hennessey
2013/0152400 A1 6/2013 Nunez
2013/0239413 A1 9/2013 Fischer
2013/0298412 A1 11/2013 Harski
2014/0033537 A1 2/2014 Ramakrishnan
2014/0068948 A1 3/2014 Marder
2014/0123506 A1 * 5/2014 Gaines ..... B26B 21/4012 30/526
2014/0150264 A1 * 6/2014 Micinilio ..... B26B 21/522 30/41
2015/0217468 A1 8/2015 Dryfhout
2015/0320172 A1 11/2015 Spencer
2016/0151925 A1 * 6/2016 Gers-Barlag ..... B26B 21/225 30/527
2017/0217035 A1 * 8/2017 Treu ..... B26B 21/522 30/526
2017/0334080 A1 11/2017 Dryfhout
2017/0334081 A1 11/2017 Dryfhout
2018/0035849 A1 2/2018 Vergara

FOREIGN PATENT DOCUMENTS

CN 2363853 Y 2/2000
CN 102196886 A 9/2011
DE 102006044316 A1 3/2008
EP 0615820 A1 * 9/1994 ..... B26B 21/522
EP 1173311 B1 1/2002
EP 1356900 A1 10/2003
EP 0885698 B1 4/2004
EP 1537964 B1 7/2010
EP 2918383 A4 * 11/2016 ..... B26B 21/522
FR 2909025 A1 * 5/2008 ..... B26B 21/522
GB 120109 A 10/1918
GB 2306373 A 5/1997
JP 9-135973 A 5/1997
JP 2004236766 A 8/2004
WO 1996004110 A1 2/1996
WO WO 2012161449 A2 * 11/2012 ..... B26B 21/522
WO WO 2015116561 A1 * 8/2015 ..... B26B 21/4081
WO WO 2017201075 A1 * 11/2017 ..... B26B 21/522
WO WO 2017201080 A1 * 11/2017 ..... B26B 21/522

OTHER PUBLICATIONS

Shave from www.inventorspot.com downloaded Jun. 24, 2008.
Mangroomer from www.amazon.com/MANGROOMER downloaded Jun. 25, 2008.
Razorba from www.razorba.com downloaded Jun. 24, 2008.
Patent Abstracts of Japan, English Language Abstract for JP-A-2004-236766 Aug. 26, 2004 Nishida.
International Search Report dated May 13, 2015 in corresponding PCT/US2015/013009.
Written Opinion of the International Searching Authority dated May 13, 2015 in corresponding PCT/US2015/013009.
Agnieszka Kozlowska, Studying Tactile Sensitivity—Population Approach, Anthropological Review, vol. 61, pp. 3-10, figs 18, tables 11, ISBN 83-86969-35-0, ISSN 0033-2003, Poznan 1998.
Sidney Weinstein, Tactile Sensitivity of the Phalanges, Perceptual and Motor Skills, 14, pp. 351-354, Southern Universities Press, © 1962.
Gemperle, F.; Hirsch, T.; Goode, A.; Pearce, J.; Siewiorek, D.; Smailigic, A. Wearable Vibro-Tactile Display. Carnegie Mellon Wearable Group, Carnegie Mellon University, 2003.
Sherrick, C. E.; Cholewiak, R. W.; Collins, A. A. The Localization of Low- and High-Frequency Vibrotactile Stimuli. Journal of the Acoustical Society of America, 88 (1), 169-179, 1990.
Verrillo, R. T. Vibrotactile Thresholds for Hairy Skin. Journal of Experimental Psychology, 72 (1), 47-50, 1966.
Zhu, B; Skin-Inspired Haptic Memory Arrays with an Electrically Reconfigurable Architecture, 2015.

(56) References Cited

OTHER PUBLICATIONS

Shih; Dubrowski; Carnahan; Evidence for Haptic Memory, 2009.
Van Erp, J.B.F. Tactile displays for navigation and orientation: perception and behavior (pp. 26-27), Soesterberg, The Netherlands: TNO Human Factors, 2007.
Myles; Binseel; The Tactile Modality: A Review of Tactile Sensitivity and Human Tactile Interfaces; ARL-TR-4115 report, 2007.
English Language Abstract for DE102006044316A1 Espacenet Bibliographic data Mar. 27, 2008.
Search Report by the Chinese Patent Office dated Aug. 18, 2017 in Chinese patent application No. 2015800064966.
Patent Abstracts of Japan for JP9-135973A with English abstract.
Espacenet—Bibliographic data for CN2329495Y with English abstract.
Espacenet—Bibliographic data for CN2363853Y with English abstract.
International Search Report dated Sep. 12, 2017 in PCT/ US2017/032949.
Written Opinion of the International Searching Authority dated Sep. 12, 2017 in PCT/ US2017/032949.
International Search Report dated Sep. 11, 2017 in PCT/ US2017/032956.
Written Opinion of the International Searching Authority dated Sep. 11, 2017 in PCT/ US2017/032956.

* cited by examiner

260

100

100

METHOD OF USING A BACK SHAVER HANDLE

BACKGROUND OF THE INVENTIONS

1. Technical Field

The present inventions relate to shavers and, more particularly, relate to long handles for body shavers.

2. Description of the Related Art

More recently, it has become very popular for men to shave their back side or body. However, it is commonly known that it can be challenging for an individual to access their own back side when shaving. It is because of this challenge that many men often recruit a partner to shave their back side. Since a partner may not always be an option a user often either pays to have their hair removed professionally or they often purchase a do-it-yourself back shaver. In order to shave one's backside or body one conventionally resorts to using an elongated handle that is attached to a blade wherein the handle is curved or angled in order to allow the user to meet their back side with the blade. Often times these elongated handles are shaped with a slight curve or even jagged angles in order to ensure the blade will meet the back side. It would be beneficial to have an improved elongated handle for shaving one's own back.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments and these and other objects and features of the inventions will be more readily understood from the following detailed description when read in conjunction with the accompanying drawings wherein.

DETAILED DESCRIPTION OF THE PREFERRED EMBODIMENTS

Figure 1:
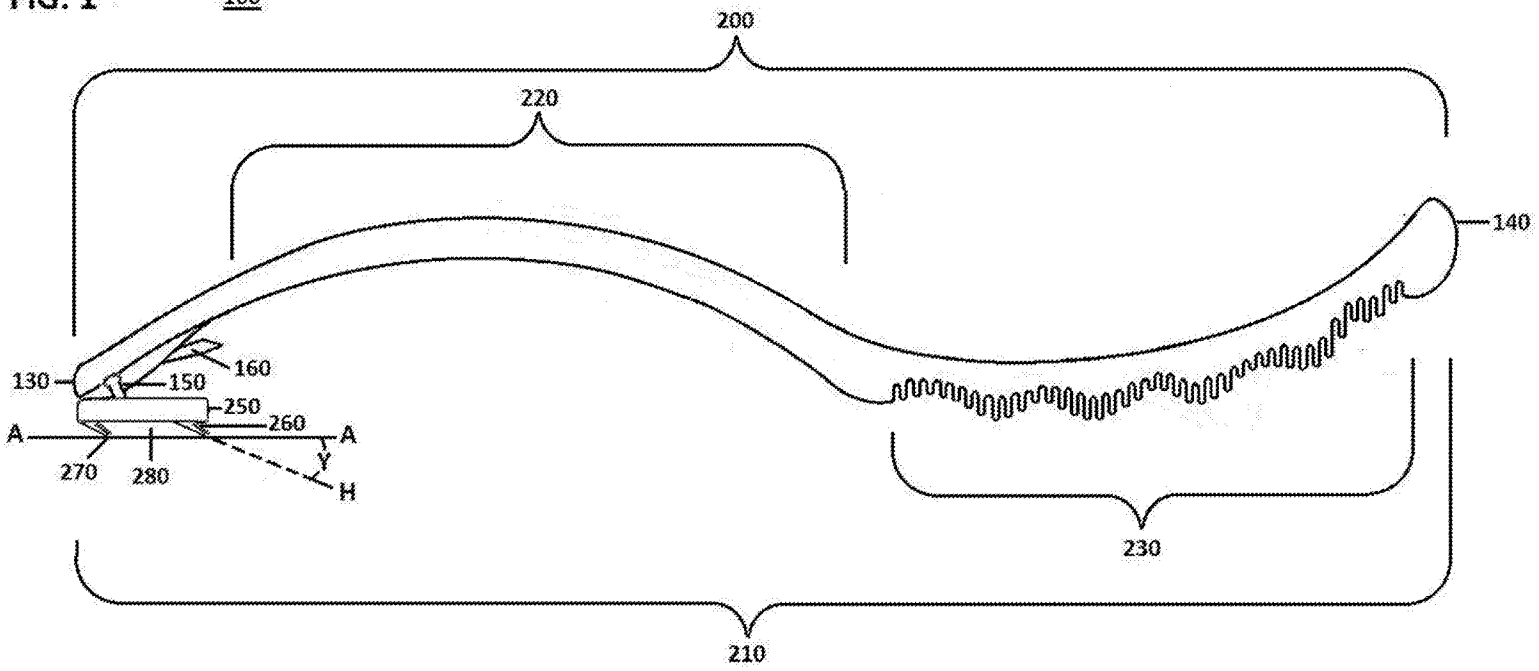
FIG. 1 illustrates a side view of a back shaver handle and safety razor according to embodiments of the present inventions.

FIG. 1 illustrates a side view of a back shaver s-shaped elongated handle 100 and safety razor 250 according to embodiments of the present inventions. The handle has a generally s-shaped elongated member 100 having a surface along a length of the s-shaped elongated member 100 defining an inner side 210 and an outer side 200 a blade end 130 and a grip end 140 and blade end 130 opposite the grip 230 and the said outer side 200 opposite the said inner side 210, and having a finger surface grip 230 located on the inner side 210 of the s-shaped elongated member 100 and the inner side 210, the outer side 200, the blade end 130, and the grip end 140 join one another to create an outer side 200 of the s-shaped elongated member 100 that is substantially smooth and a cross-sectional shape of the s-shaped elongated member 100 near the midway is substantially smooth having a shape that is substantially round or oval and a blade attachment 150 at the blade end 130 of the s-shaped elongated member 100 opposite the grip end 140. The blade attachment 150 located on the inner side 210 of the s-shaped elongated member 100 and blade attachment 150 comprises a handle clip 160 used to lock and release a safety razor 250 in the blade attachment 150. The blade attachment 150 attaches to the safety razor 250 with a blade group 260 and blade group 270 protruding away from the safety razor 250 on the inner side 210 of the s-shaped elongated member 100 facing against the torso backside of the user. The blade group 260 and blade group 270 having tips creating the angle of the sharp blade 110 in relation to a flat skin plane A. FIG. 1 illustrates a plurality of blade groups protruding at an angle away from the safety razor 250 which are illustrated as the primary blade group 260 and the secondary blade group 270 and a sensory gap 280 inside of the blade group 260 and blade group 270. The sensory gap 280 illustrated in FIG. 1 and serves multiple purposes. The first purpose is to allow balance and angle control between the safety razor 250 and skin surface A when stroking against the skin surface A. The sensory gap 280 also grants space for a skin to convex and enter in allowing a user to maintain an effective angle between blade groups and a skin surface without the skin surface rubbing against the safety razor 250 and disrupting a shaving stroke. The sensory gap 280 also creates an effective amount of distance between blade group 260 and blade group 270 in order to allow two-point discrimination which will be further described in the upcoming FIGS. 5-8. The blade group 260 assembly will further be illustrated in FIGS. 7-8. Blade group 260 and blade group 270 may be positioned at a wide range of angles in relation to the skin plane A. A midpoint of a non-flexing portion of a sharp blade is illustrated as midpoint H. Midpoint H is illustrated with a dashed line in order to show angle. The angle of midpoint H in relation to the flat skin plane A is referenced as angle Y. Angle Y is approximately 20 degrees. Although many angles will work efficiently, the preferred angle of angle Y is approximately 20 degrees. The safety razor 250 having at least one or more blade groups at an angle from the said safety razor 250 and allowing said safety razor 250 the capability of stimulating the mechanoreceptors as well as promoting two-point discrimination which will be further discussed in FIGS. 3-8.

The s-shaped elongated member 100 has a straight line length measured directly from the from the blade end 130 to the grip end 140 of about 330 mm to about 457.2 mm. A preferred straight line length of the s-shaped member 100 is approximately 355.6 mm. This straight line length is measured across in a straight line from end to end, not following the curve of the s-shaped member 100.

The blade attachment 150 is a portion of the s-shaped elongated member 100 near the blade end 130 that attaches to an attachment on the safety razor 250. In order for the blade attachment 150 to function there is also an attachment on the safety razor 250 for the s-shaped elongated member 100 to attach itself to. The blade attachment 150 and a attaching piece on the safety razor 250 may take many different forms to allow both safety razor 250 and elongated member 100 to removably attach with one another.

A body leverage surface 220 is located on the outer side 200 of the s-shaped elongated member 100 near a midway between the grip 230 and the blade end 130 and the blade end 130 configured to press the body leverage surface 220 against a user's forearm when the grip 230 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment 150 located on the inner side 210 of the s-shaped elongated member 100 against a torso backside of the user. This will be further illustrated in the upcoming FIGS. 3-6 and FIGS. 10-19.

Letter designations in the drawings depict certain planes, gap distances and contours, defined throughout, and for convenience are summarily defined wherein:

"A" references a flat skin plane;

"Y" references the angle between midpoint H in relation to a flat skin plane A which is referenced as angle Y; and "H" references the midpoint section of a non-flexing sharp blade 110.

Figure 2:
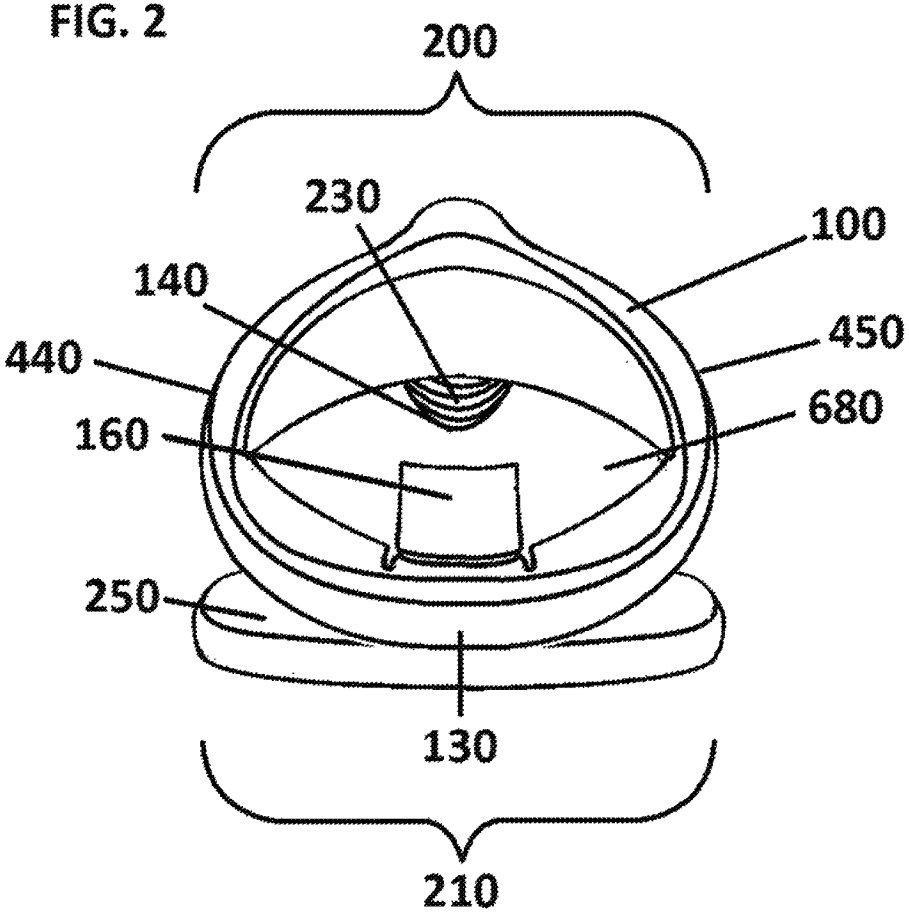
FIG. 2 illustrates a front view of a back shaver handle and safety razor according to embodiments of the present inventions.

FIG. 2 illustrates a front view of a back shaver handle and safety razor according to embodiments of the present inventions. The back shaver handle with an s-shaped elongated member 100 has a surface along a length of the s-shaped elongated member 100 defining a left side 440 and a right side 450 a blade end 130 opposite a grip end 140 and the left side 440 opposite the right side 450 and the grip end 140 and blade end 130 between the left side 440 and right side 450. A safety razor 250 is not included when referencing the left side 440 and the right side 450 of the s-shaped elongated member 100. The generally s-shaped elongated member 100 having a surface along a length of the s-shaped elongated member 100 defining an inner side 210 and an outer side 200 and the blade end 130 opposite the grip end 140 and blade end 130 opposite the grip 230 and the said outer side 200 opposite the said inner side 210, and having a finger surface grip 230 located on the inner side of the s-shaped elongated member 100 and wherein the inner side 210, the outer side 200, the blade end 130, and the grip end 140 join one another to create an outer side 200 surface of the s-shaped elongated member 100. The s-shaped elongated handle 100 also having an elongated member opening 680 which is inside of the grip 230 and grip end 140 and allowing an elongated soft sponge or cushion to anchor itself into place which will be further described and illustrated in the upcoming FIGS. 20-22. The s-shaped elongated handle 100 also having a handle clip 160 for removably attaching the safety razor 250 near the blade end 130. In another embodiment the handle clip 160 may be embodied on either the safety razor 250 or the s-shaped elongated member 100.

Figure 3:
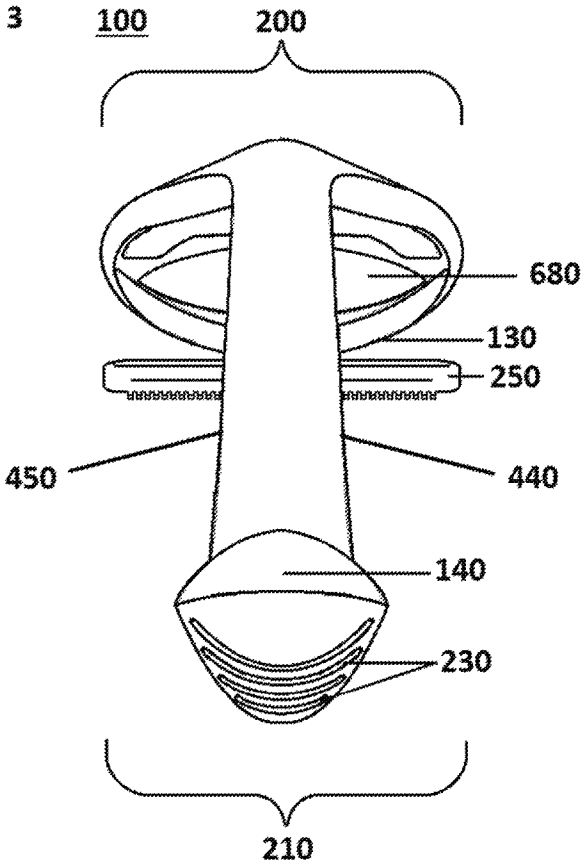
FIG. 3 illustrates a rear view of a back shaver handle and safety razor according to embodiments of the present inventions.

FIG. 3 illustrates a rear view of a back shaver handle and safety razor according to embodiments of the present inventions. The back shaver handle with an s-shaped elongated member 100 has a surface along a length of the s-shaped elongated member 100 defining a left side 440 and a right side 450 a blade end 130 and a grip end 140 and the left side 440 opposite the right side 450 and the grip end 140 and blade end 130 between the left side 440 and right side 450. A safety razor 250 is not included when referencing the left side 440 and the right side 450 of the s-shaped elongated member 100. The generally s-shaped elongated member 100 having a surface along a length of the s-shaped elongated member 100 defining an inner side 210 and an outer side 200 the blade end 130 opposite the grip end 140 and blade end 130 opposite the grip 230 and the said outer side 200 opposite the said inner side 210, and a finger surface grip 230 located on the inner side 210 of the s-shaped elongated member 100 and wherein the inner side 210, the outer side 200, the blade end 130, and the grip end 140 join one another to create an outer side 200 surface of the s-shaped elongated member 100. The s-shaped elongated handle 100 also having an elongated member opening 680 which is inside of the blade end 130 and the grip 230 and allowing an elongated soft sponge or cushion to anchor itself into place which will be further described and illustrated in the upcoming FIGS. 20-22.

Figure 4:
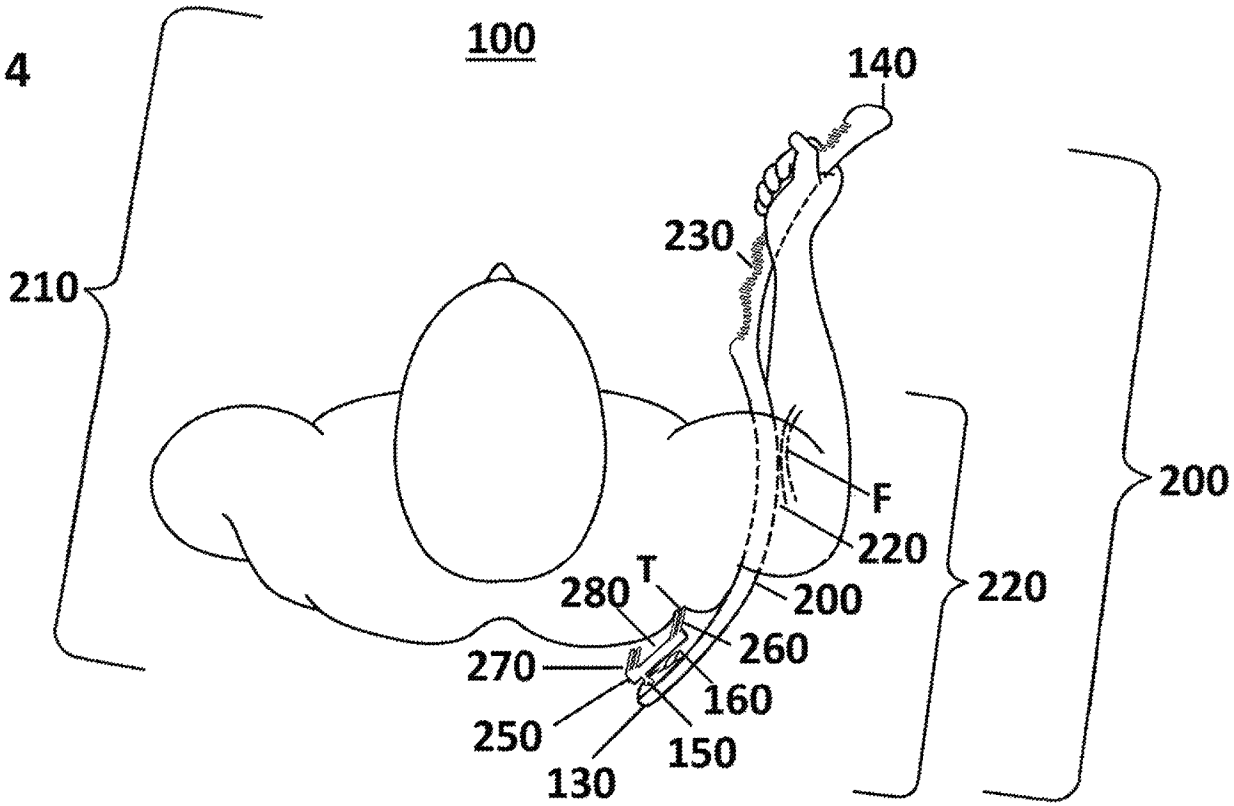
FIGS. 4-5 illustrate aerial views of a handle gripped by a user extended under the armpit towards the backside with one of two safety blades indenting into the skin surface according to embodiments of the present inventions.
Figure 5:
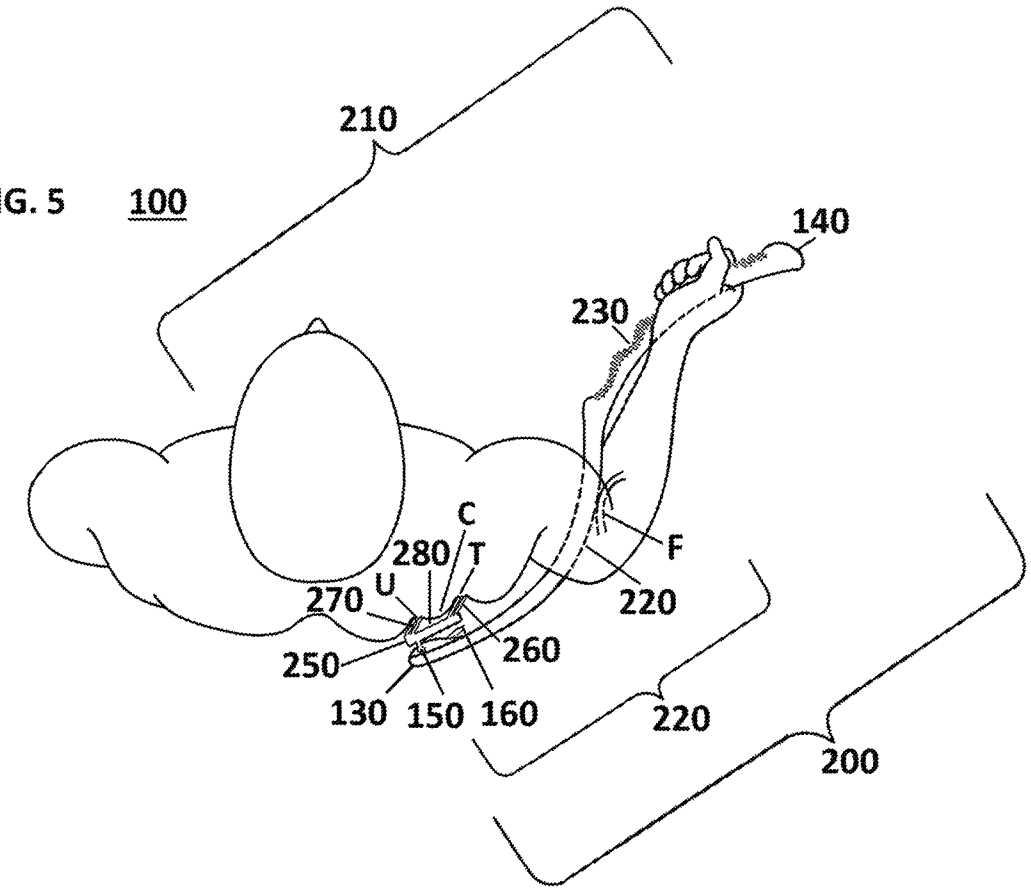

FIG. 4-5 illustrates aerial view of a handle gripped by a user extended under the armpit towards the backside according to embodiments of the present inventions. The handle has a generally s-shaped elongated member 100 having a surface along a length of the s-shaped elongated member 100 defining an inner side 210 and an outer side 200 a blade end 130 and a grip end 140 and the said outer side 200 opposite the said inner side 210 and the and said inner side 210 and having a finger surface grip 230 located on the inner side of the s-shaped elongated member 100 and wherein the inner side 210, the outer side 200, the blade end 130, and the grip end 140 join one another to create an outer side 200 surface of the s-shaped elongated member 100 that is substantially smooth and a cross-sectional shape of the s-shaped elongated member 100 near the midway is substantially smooth having a shape that is substantially round or oval.

In FIGS. 4-5 a blade attachment 150 at the blade end 130 of the s-shaped elongated member 100, the blade end 130 located at an end of the s-shaped elongated member 100 opposite the grip end 140, the blade attachment 150 located on the inner side 210 of the s-shaped elongated member 100 and a handle clip 160 used to removably attach or detach a safety razor 250 in the blade attachment 150. The blade attachment 150 attaches to the safety razor 250 with at least a blade group 260 and blade group 270 protruding away from the safety razor 250 on the inner side 210 of the s-shaped elongated member 100 facing against the torso backside of the user. FIGS. 4-5 illustrate multiple blade groups which are referenced as primary blade group 260 and secondary blade group 270. The safety razor 250 having at least one or more blade groups at an angle from the safety razor 250 and the blade group 260 and blade group 270 having tips capable of stimulating the mechanoreceptors as well as promoting two-point discrimination.

In FIGS. 4-5 a body leverage surface 220 is located on the outer side 200 of the s-shaped elongated member 100 near a midway between the finger surface grip 230 and the blade end 130 and the blade end 130 configured to press the body leverage surface 220 against a user's forearm when the finger surface grip 230 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment 150 located on the inner side 210 of the s-shaped elongated member 100 against a torso backside of the user.

As seen in FIG. 4 when the finger surface grip 230 are respectively gripped by fingers and hand by a same arm of the user the user is illustrated pressing a body leverage surface 220 located on the outer side 200 of the s-shaped elongated member 100 near a midway between the grip 230 and the blade attachment 150 and configured to press the body leverage surface 220 against a user's forearm, in which the fulcrum is referenced as F, in order to leverage the blade attachment 150 located on the inner side 210 of the s-shaped elongated member 100 against a torso backside of the user and leveraging the s-shaped elongated member 100 using the body leverage surface 220 as a fulcrum F relative to the grip 230 to press the blade end 130 towards the torso backside of the user and stroking the blade end 130 against the torso backside of the user.

It can be seen in FIG. 4 the blade group 260 is pressing into the skin and is creating a skin convex T inside of the blade group 260. A blade group 260 is creating the first of two points in the two-point discrimination study. The two-point discrimination test or the two-point discrimination study offers an understanding on how the components found within the sensory system may be utilized to establish effective communication in utilizing the sensory system without having to actually view the location where the senses are being activated, or in my invention, where at least two safety razors illustrated by primary blade group 260 and secondary blade group 270 of the safety razor 250 are safety poking the skin surface on the backside or body. In FIG. 4 the first of two points is safely poking into the skin creating skin convex T and at the same time stimulating the sensory system. The two-point discrimination illustrates the ability to discern that two or more nearby objects gouging or poking the skin are truly multiple distinct points set apart from each other and allowing a user to understand the location of each point. It is often tested with points creating sufficient indents into the skin, as illustrated in my invention, in order to assure the communication is effective. It can be seen in FIG. 4 that the blade group 260 is creating skin convex T wherein in the upcoming FIG. 5 the secondary blade group 270 is creating skin convex U which is the second of the two points in the two-point discrimination study. In FIG. 4 a portion of the safety razor 250 inside of blade group 260 and secondary blade group 270 is removed in order to create a sensory gap 280. Sensory gap 280 serves multiple purposes. The first purpose of a sensory gap 280 is to allow a user to find an effective cutting angle between blade group 260 and blade group 270 in relation to the skin surface. Since blade group 260 and blade group 270 have tips at a distance from the safety razor 250 the ability to both stabilize the safety razor 250 and find the correct shaving angle is key. Having at least two blades groups allows effective stability between one another and the safety razor 250 when stroking against the skin surface. The sensory gap 280 also creates an effective amount of distance between blade group 260 and blade group 270 in order to allow two-point discrimination which will be further described in the upcoming FIGS. 6-9. It can be seen in FIG. 4-5 that the s-shaped elongated handle 100 surface opposite the grip 230 on the outer side 200 is pressing against the inside of the forearm creating stability for the wrist area and preventing health issues related to the wrist which will be further discussed in the upcoming FIG. 10.

In research and clinical studies, two-point discrimination is a widely used technique for determining tactile agnosia. According to Sir Sidney Weintein, who tested Weber's observations published in 1835, he finds the theory that there is a lack of uniformity of tactile sensitivity found throughout the body to be correct. In 1960 Sidney Weinstein decided to test the two-point discrimination theory to determine what areas of the body were more sensitive than others. In fact, he concluded the areas of the body such as the face, lips or fingers require less distance between the two points or indents in order to distinguish the two points. During the testing, he found the skin surface located on the back required much more distance between each point in order for the participant to differentiate the two points. However, the exact distance can be influenced based on whether or not the individual the individual has hair on their back. In hairy skin, Merkel nerve endings are clustered into specialized epithelial structures called "touch domes" or "hair disks". An individual with hair grown in on their backside have additive sensitivity to pressure or skin indentations with the presence of Merkel nerve endings. Merkel nerve endings are found in the basal layer of glabrous and hairy skin and in hairs as well. They provide information on pressure and deep touch which in my invention are provided by blade group 260 and blade group 270.

Furthermore, my invention also adheres to the Atkins-Shiffrin theory. According to the Atkins-Shiffrin theory, memory involves three distinct but related processes: sensory memory, short-term memory and long-term memory. Together, these processes provide the avenue for environmental information to be received by the senses and either put to use, stored for later use or ignored altogether. Most people associate memory processes exclusively with the brain, and for the most part, that is accurate. The sensory memory is responsible for getting the information from the senses to the brain. Our senses are directly linked to our central nervous system, which is comprised of our spinal cord and brain. The process of getting information from our senses to our brain happens very quickly. In fact, it happens so quickly that we are not always consciously aware of everything that is being picked up by our senses.

Sensory memory allows environmental information to be retained, sometimes for as little as a fraction of a second, as it makes its way into our consciousness. Our sensory systems are constantly receiving and processing an incredible amount of information at any given moment. As we go through our day, it is virtually impossible to consciously recognize all of this information. Sensory memory absorbs a tremendous amount of environmental information. It also provides our brains with a lot of details in a short amount of time. Sensory memory allows our brains to make quick reactions and judgments without having to wait on the information to be processed by conscious thoughts. Quite often the information taken in through the senses does end up being consciously processed and used in short-term memory or stored in long-term memory, but thanks to sensory memory, our brains can rapidly sense and perceive a host of environmental information while our brains decide what is useful and what is not.

After stroking the safety razor 250 against the skin during the shaving process a user may not only have an understanding as to the location of blade group 260 and blade group 270 but it can be said that the sensor memory also allows the user to, for a brief period of time, understand where the safety razor 250 has just been even where the safety razor 250 is no longer present. This means that a user would be able to understand that they have been shaving in one area and may dictate where they need to stop and start based on a communication set forth with sensory memory.

Letter designations in the drawings depict certain planes, gap distances and contours, defined throughout, and for convenience are summarily defined wherein:

"T" references a skin convex inside a blade group 260;

"U" references a skin convex inside a blade group 270; and

"F" references a fulcrum between a body leverage surface 220 relative to the grip 230 of an elongated s-shaped elongated handle 100 to press the blade end 130 of an s-shaped elongated handle 100 towards the torso backside of the user.

FIG. 5 illustrates an aerial view of an s-shaped elongated handle 100 gripped by a user extended under the armpit towards the backside according to embodiments of the present inventions. It can be seen in FIG. 5 the secondary blade group 270 is now pressing into the skin and is creating a skin convex inside of the blade group 270 in which the skin convex is referred to as U along. The blade group 260 is also indenting into the skin with a tip creating skin convex T. Blade group 270 is creating the second point or indentation in the two-point discrimination study and creating skin convex U. As illustrated in FIG. 5 the user may now understand the location of both of the two points and the user's sensory system is effectively communicating and allowing the user to know the location of each point as is true within two-point discrimination. This form of communication is even further illustrated in the upcoming FIGS. 6-9. Furthermore, in FIG. 5 it can be seen a skin convex has formed inside of blade group 260 and blade group 270 which is referred to as skin convex C. Skin convex C is granted space to form and to not rub against the safety razor 250 which would disrupt a shaving stroke. The blade attachment 150 is a portion of the s-shaped elongated member 100 near the blade end 130 that attaches to an attachment on the safety razor 250. In order for the blade attachment 150 to properly function there is also an attachment on the safety razor 250 for the s-shaped elongated member 100 to attach itself to. The blade attachment 150 and a attaching piece on the safety razor 250 may take many different forms to allow both safety razor 250 and elongated member 100 to removably attach with one another.

Letter designations in the drawings depict certain planes, gap distances and contours, defined throughout, and for convenience are summarily defined wherein:

"C" references a convex skin surface contour engaged in a convex contour inside a blade group 260 and a blade group 270.

Figure 6:
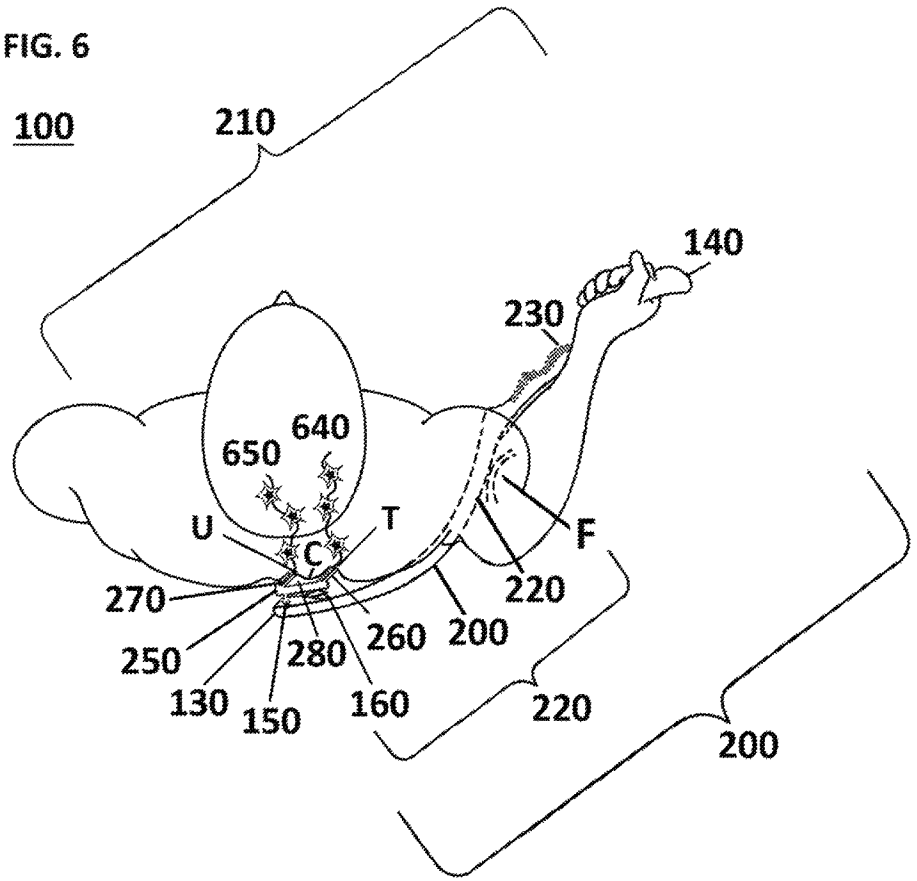
FIGS. 6-7 illustrate aerial views of handles gripped by a user extended under the armpit towards the backside with two safety blades indenting into the skin surface and triggering a sensory system according to embodiments of the present inventions.
Figure 7:
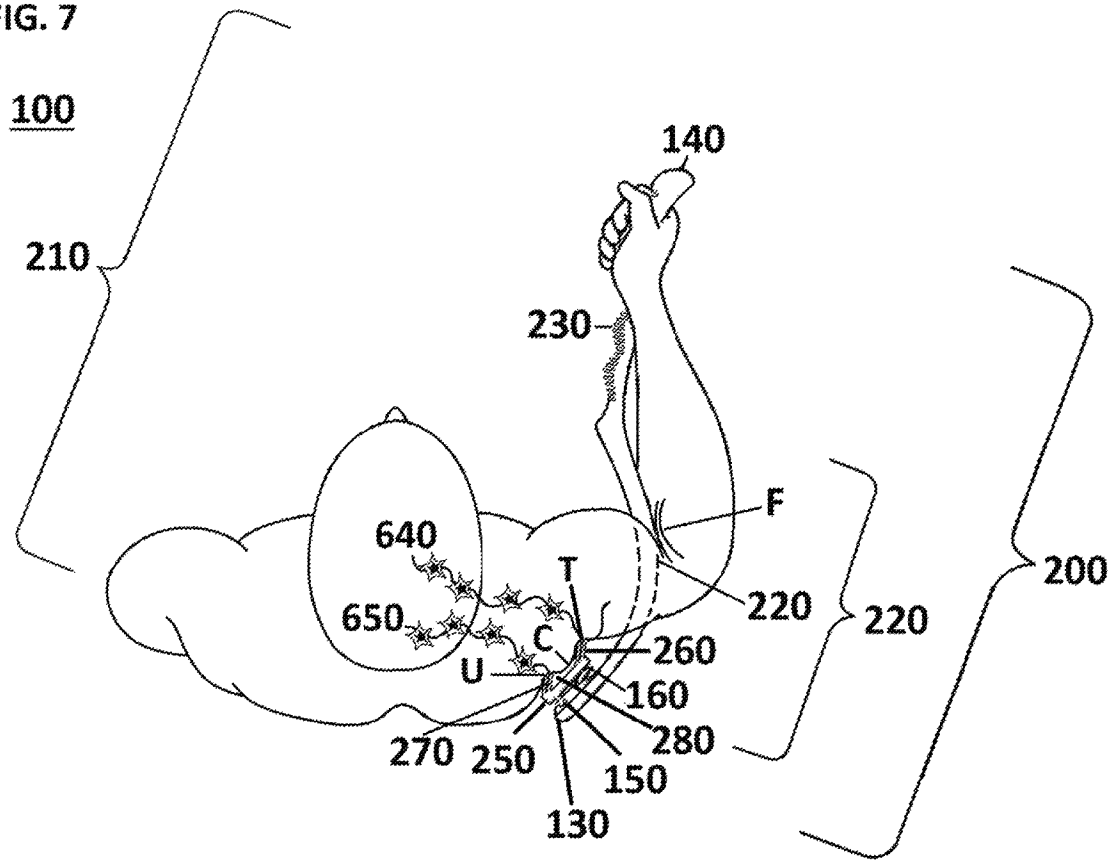

FIGS. 6-7 illustrate aerial views of handles gripped by a user extended under the armpit towards the backside with two safety blades indenting into the skin surface and triggering a sensory system according to embodiments of the present inventions. The handles has a generally s-shaped elongated member 100 having a surface along a length of the s-shaped elongated member 100 defining an inner side 210 and an outer side 200 a blade end 130 and a grip end 140 and blade end 130 opposite the grip end 140 and the said outer side 200 opposite the said inner side 210, and having a finger surface grip 230 located on the inner side 210 of the s-shaped elongated member 100 and wherein the inner side 210, the outer side 200, the blade end 130, and the grip end 140 join one another to create an outer side 200 surface of the s-shaped elongated member 100 that is substantially smooth and a cross-sectional shape of the s-shaped elongated member 100 near the midway is substantially smooth having a shape that is substantially round or oval and a blade attachment 150 at the blade end 130 of the s-shaped elongated member 100 located at an end of the s-shaped elongated member 100 opposite the grip end 140, the blade attachment 150 located on the inner side 210 of the s-shaped elongated member 100 and the blade attachment 150 comprises a handle clip 160 removably attaching a safety razor 250 in the said blade attachment 150. The blade attachment 150 attaches to a safety razor 250 with at least blade group 260 protruding at an angle away from the safety razor 250 on the inner side 210 of the s-shaped elongated member 100 facing against the torso backside of the user. The safety razor 250 having at least one or more blade groups at an angle from the said safety razor 250 and as seen in FIGS. 6-7 there are two blade groups present. Blade group 260 and blade group 270 are both present. A portion of the safety razor 250 inside of blade group 260 and secondary blade group 270 is removed in order to create a sensory gap 280. Sensory gap 280 serves multiple purposes. The first purpose is to allow balance and stability of between the blade group 260 and blade group 270 in relation with the safety razor 250 against a skin surface when stroking against the skin surface and to create a preferred shaving angle between the safety razor 250 and skin surface. Sensory gap 280 also grants space for the skin convex C to enter in. Skin convex C is a direct result from having two points indented into a skin surface which deforms the skin and creates a convex C inside blade group 260 and blade group 270. Sensory gap 280 may also prevent a skin convex C from pressing or rubbing against the safety razor 250 and interrupting the shaving process. The sensory gap 280 also creates an effective amount of distance between blade group 260 and blade group 270 in order to allow two-point discrimination. It can be seen in FIG. 6-7 that the outer side 200 of the s-shaped elongated handle 100 surface opposite the grip 230 is pressing against the inside of the forearm creating stability for the wrist area and preventing health issues related to the wrist which will be further discussed in the upcoming FIG. 10. Safety razor 250 is capable of stimulating the mechanoreceptors as well as promoting two-point discrimination. Point one of the two-point discrimination is represented by T and is created by primary blade group 260. Point two of the two-point discrimination is represented by U and is created by secondary blade group 270 while a skin convex C is inside of sensory gap 280 which is inside of blade group 260 and blade group 270.

A body leverage surface 220 is located on the outer side 200 of the s-shaped elongated member 100 near a midway between the grip 230 and the blade end 130 and the blade end 130 configured to press the body leverage surface 220 against a user's forearm when the grip 230 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment 150 located on the inner side 210 of the s-shaped elongated member 100 against a torso backside of the user.

As illustrated in FIGS. 6-7, when the finger surface and grip 230 are respectively gripped by fingers and hand by a same arm of the user the user is illustrated pressing a body leverage surface 220 located on the outer side of the s-shaped elongated member 100 near a midway between the grip 230 and the blade end 130 configured to press the body leverage surface 220 against a user's forearm in order to leverage the blade attachment 150 located on the inner side 210 of the s-shaped elongated member 100 against a torso backside of the user and leveraging the s-shaped elongated member 100 using the body leverage surface 220 to create a fulcrum F relative to the grip 230 in order to press the blade end 130 towards the torso backside of the user and stroking the blade end 130 against the torso backside of the user. FIGS. 6-7 illustrate star shaped figures dispatching from indentation U and indentation T. The first sensory signal 640 is being created from the indentation T while the second sensory signal 650 is being created from the indentation U. These stars represent the sensors of which are being communicated through the sensory system. Sensory signals are communicating through the sensory system to the user's brain allowing the user to understand that both the first point T being created by blade group 260 as well as the second point U being created by secondary blade group 270 are both indenting into the skin and allowing the user to understand the location of the safety razor 250 as well as whether or not blade group 260 and secondary blade group 270 are at the preferred angle. It can be seen that when comparing FIGS. 6 to 7 the safety razor 250 has made a shaving stroke across the back side. During this process it can be seen that during the two-point discrimination process the sensors have shifted from one area of the backside to another allowing a user a clearer understanding that the safety razor 250 has moved from one location to another new location. This decreases the possibility of duplicating efforts by unnecessarily shaving an area more than once which is commonly found to happen when a user is able to physically view their backside during the shaving process. The blade attachment 150 is a portion of the s-shaped elongated member 100 near the blade end 130 that attaches to an attachment on the safety razor 250. In order for the blade attachment 150 to properly function there is also an attachment on the safety razor 250 for the s-shaped elongated member 100 to attach itself to. The blade attachment 150 and a attaching piece on the safety razor 250 may take many different forms to allow both safety razor 250 and elongated member 100 to removably attach with one another.

Figure 8:
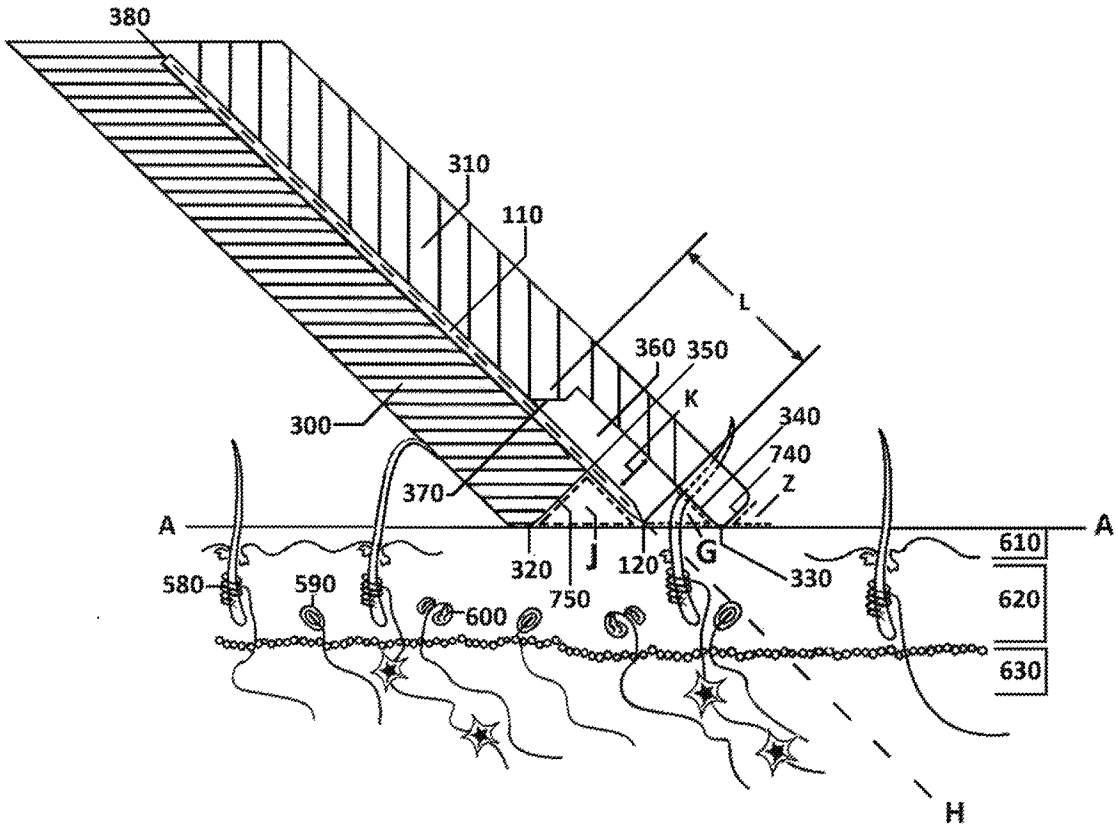
FIG. 8 illustrates a cross-section of a blade group at rest according to embodiments of the present inventions.
Figure 9:
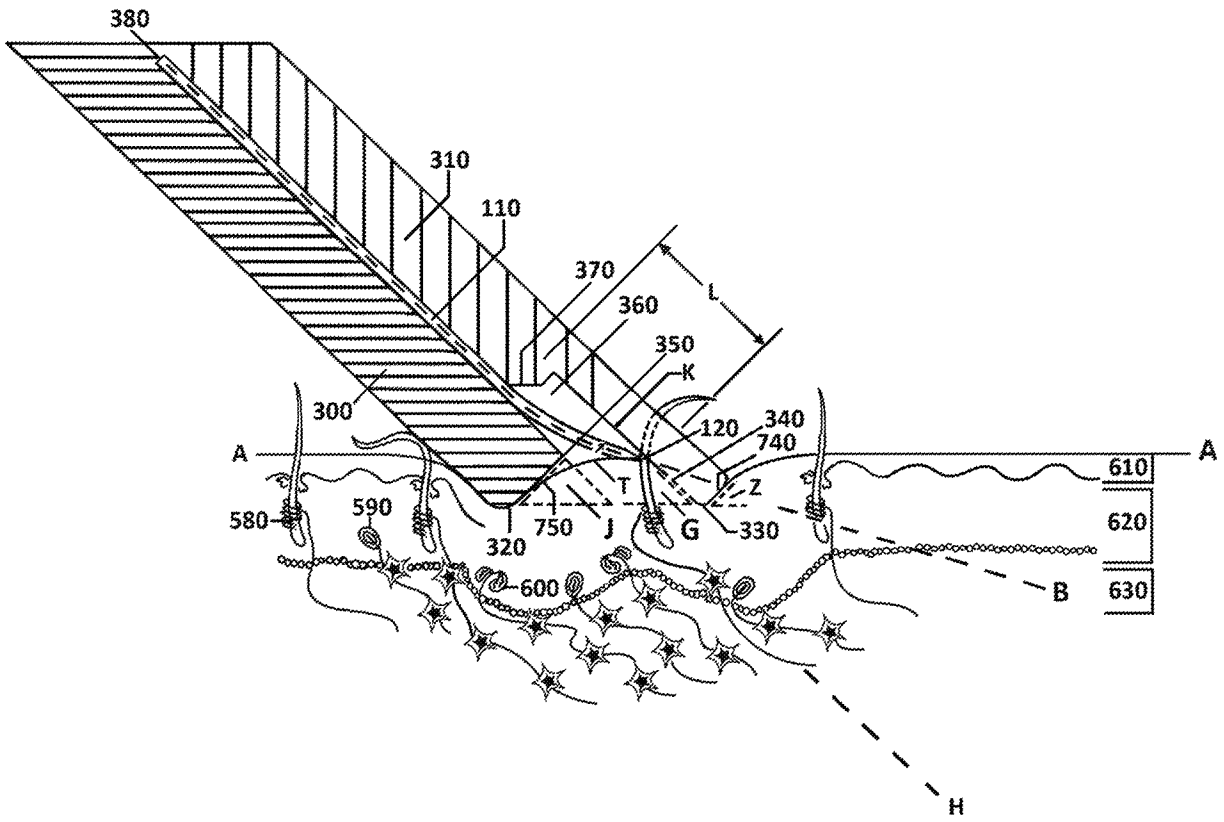
FIG. 9 illustrates a cross-section of a blade group pressing into skin according to embodiments of the present inventions.

FIG. 8 illustrates a cross-section of a blade group 260 at rest and FIG. 9 illustrates a cross-section of a blade group 260 pressing into skin according to embodiments of the present inventions. The blade group 260 comprising at least one flexible sharp blade 110 comprising a sharp edge 120 facing towards a skin surface A and an outer comb 310 having an inside edge 330 and an inside wall 340 and an inner guard 300 comprising an inner guard outer edge 320 and an inner guard inside end 350. Inner guard inside end 350 is embodied where an inner guard inside wall 750 and the sharp blade 110 meet. Inner guard outer edge 320 and inside edge 330 shaped to safely poke and indent into a skin surface. An inside portion of the outer comb 310 removed in order to create a deep void 360. A sharp blade 110 is fixedly anchored on the sharp blade end 380 opposite the sharp edge 120. Deep void 360 has a thickness allowing a level of control over the flexibility of a sharp blade 110 as well as over-exposure of a sharp blade 110. A deep void 360 is spaced intermediately of outer comb 310 and sharp blade 110. Deep void 360 having a thickness which is represented as K. A preferred thickness K is 0.014 inches (0.03556 centimeter) or less in order to control over exposure of sharp edge 120 of sharp blade to a skin surface A. K may run thicker but the danger of cutting becomes increasingly probable. The level of distance of the deep void 360 between the base 370 and the sharp edge 120 of the sharp blade 110 is referenced as L. In a preferred embodiment in this invention the distance of L is between 0.014"-0.04" inches (0.2032 centimeter-0.1016 centimeter). Although L may be less or greater than the preferred distance if the distance becomes much less than 0.04" inches (0.1016 centimeter) then the sharp blade 110 becomes more rigid and less able to bend and the sharp blade 110 may become more of a dagger which can be dangerous. If the distance of L becomes too great or greater than 0.014" inches (centimeter) then the sharp blade 110 will bend too easily and will run the danger of not cutting effectively. The outer comb 310 inside wall 340 creates a barrier for the skin surface convex C which is illustrated in FIG. 9. In FIG. 8 the midpoint of the sharp blade 110 is referred to as H. In FIG. 8 the inner guard 300 and outer comb 310 are not indenting into the skin surface A and thus sharp blade 110 is not pressing against a skin surface A and the sharp blade 110 is uninterrupted and thus the midpoint H is uninterrupted and is linear. In FIG. 9 the sharp blade 110 is bending and the midpoint of the flexing sharp edge 120 is referenced as midpoint B which is directed at an alternate angle in comparison to the midpoint.

In FIGS. 8-9 a base 370 is positioned to create a level of distance between the base 370 and sharp edge 120 of sharp blade 110 in order to enable a controlled level of flexibility with the sharp blade 110. A sharp blade exposure is the margin of sharp blade 110 rearward the sharp edge 120 of the sharp blade 110 and up to the inner guard inside end 350. Sharp blade exposure should be approximately 0.030" inches (0.0762 centimeter) or less.

An inside portion of the inner guard 300 tip removed in order to create a trailing opening referenced with a J is illustrated as a dashed triangle inside of the inner guard outer edge 320 of an inner guard 300 and the sharp edge 120 of the sharp blade 110. The trailing opening J cross section has three triangular corners or vertices which have three walls but it is not a perfect triangle being that the three walls or sides are not always flat. This is especially true of the sharp blade and the skin surface which both flex under pressure. The sharp blade 110, which forms one of the walls or sides will flex and bend. The inner guard inside wall 750 which is inside the inner guard outer edge 320 and the Inner guard inside end 350 create the second wall or side. The skin surface is the third and final wall or side inside of the sharp edge 120 or sharp blade 110 and the inner guard outer edge 320 which also deforms and will convex when the blade group 260 is pressed into the skin surface. As the skin deforms and tightens itself allowing the sharp blade 110 to access the base of a hair 580, a clean shave results leaving a smooth skin surface after a shaving stroke. In FIGS. 8-9 the first of the vertices is where the inner guard inside end 350 and the sharp blade 110 meet. The second of the vertices is where the sharp blade 110 and the skin surface A intersect. The third of the vertices is where the skin surface A and the inner guard outer edge 320 of the inner guard 300 meet. The vertices of an imaginary triangle work to together to form the planes that create trailing opening J allowing for a controlled opening or space for tightening skin to enter and convex which in the upcoming FIG. 9 where the skin convex is illustrated. The vertices work to together to form the trailing opening J which in FIG. 9 is allowing a skin convex, referenced as skin convex T, to enter into the blade group 260 and allowing a controlled opening for tightening skin to enter and convex T. In FIG. 9 the inner guard 300 inner guard outer edge 320 and the outer comb 310 inside edge 330 simultaneously dig into the skin surface A in order to tighten the skin so that when the hair 580 is presented to the sharp blade 110 the root or base of a hair 580 is being greatly exposed which allows for a cleaner and more effective cut. A vertex also inside an outer wall 740 of outer comb 310 and a skin plane A which is referenced as vertex Z. Vertex Z allows the outer comb 310 to better indent into the skin during a shaving stroke.

In FIG. 8 blade group 260 is not yet pressing into the skin surface A and thus the sharp blade 110 is illustrated in a stationary position. In FIG. 8 it can be seen that the sensors that require pressure in order to trigger such as the Pacinian Corpuscle 590 and the Ruffini's Corpuscle 600 are not yet being triggered since there is only light touch between the blade group 260 and the skin surface A. Only the hairs 580 may detect the light touch. It can be seen in the illustration the tissue sub layers and the sensors within each layer which include the Epidermis 610, the Dermis 620 and the Hypodermis 630. In FIG. 9 the inner guard 300 inner guard outer edge 320 and the inside edge 330 simultaneously dig into the skin surface A in order to tighten the skin so that when the hair 580 is presented to the sharp blade 110 the root or base is being greatly exposed and the Pacinian Corpuscle 590 and the Ruffini's Corpuscle 600 are being triggered along with the hair 580. The outer comb 310 inside edge 330 having a leading opening G wherein the leading opening G is inside of the inside edge 330 and the sharp edge 120 of the sharp blade 110. In FIG. 9 the leading opening G allowing the skin to convex against the comb inside wall 340 which is inside the inside edge 330 and the sharp edge 120 controlling the amount of skin entering the blade group 260.

In FIGS. 8-9 a deep void 360 thickness allowing a level of control over the flexibility of the sharp blade 110 as well as over-exposure of the sharp blade 110. FIG. 9 illustrates a cross-section of a blade group 260 pressing into skin according to embodiments of the present inventions. The blade group 260 is safely poking or indenting into the skin surface A in order for the blade group 260 to work properly as well as to create tactile feedback within the practice of two-point discrimination. As illustrated in FIG. 9 a blade group 260 pressing the inside edge 330 and the inner guard outer edge 320 of the blade group 260 into the skin surface during shaving of hair 580 and comprising at least one flexible sharp blade 110 comprising a sharp edge 120 facing against a skin surface A. As the blade group 260 is pressing into the skin surface the flexible sharp blade 110 is longitudinally bending relatively more parallel to a skin surface convex T creating a much less aggressive cutting angle between sharp blade 110 and a skin surface. In FIGS. 8-9 the blade group 260 comprising at least one flexible sharp blade 110 comprising a sharp edge 120 facing against the torso backside of the user, and an outer comb 310 comprising an inside edge 330 which is preferably 0.030 inches or less from the sharp edge 120 of a sharp blade. Of course other alternative measurements will work, however, being that the inside edge 330 serves a purpose of indenting into the skin to create a tightened skin convex T it can be said that in order to gain better access to the base of a hair 580 with the sharp edge 120 it is obvious for the sharp edge 120 to be in close proximity to the inside edge 330. The trailing hairs illustrated in FIG. 9 are not shorn because the blade group 260 is merely pressing into the skin surface. If the blade group 260 were moving forward making a shaving stroke the hairs will become shorn.

As can be seen in FIG. 9, the blade group 260 at an angle is capable of safely poking the skin surface A and tightening the skin between inner guard outer edge 320 and the inside edge 330 of the outer comb 310. The inner guard 300 inner guard outer edge 320 and the outer comb 310 inside edge 330 simultaneously dig into the skin surface A in order to tighten the skin so that when the hair 580 is presented to the sharp blade 110 the root or base is being greatly exposed. As can be seen in FIG. 9 the skin surface A is being poked and the mechanoreceptors are being stimulated. It can be seen in the illustration the tissue sub layers and the sensors within each layer which include the Epidermis 610, the Dermis 620 and the Hypodermis 630. For the sake of clarity the sensors located in the deep tissue sub layers are illustrated as being activated from the poke. The star shape embodied on the strand of the sensor indicates the communication taking place. The illustrated sensors include the Ruffini's Corpuscle 600, which are found in the Dermis 620 of the skin and the Pacinian Corpuscle 590, which are found in the "subcutaneous" or hypodermis 630. It can be seen front FIG. 8 that the Pacinian Corpuscle 590 and the Ruffini's Corpuscle 600 is now actively being triggered due to the skin stretching and pressure from the inner guard 300 and the outer comb 310 into the skin surface A and forming a tightening skin convex T in order to exposure the base of a hair.

Letter designations in the drawings depict certain planes, gap distances and contours, defined throughout, and for convenience are summarily defined wherein:

"J" references an opening inside an edge of a sharp blade and an inner guard outer edge 320;

"G" references an opening inside an edge of a sharp blade and an inside edge of a comb;

"L" references the deep void 360 running lengthwise from the inside edge 330 of outer comb 310 to the base 370 which allows ample space for the preferred flexibility of a sharp blade 110 to outer comb 310 inside;

"Z" references a vertices created between an outer wall 740 of outer comb 310 and a flat skin plane A; and "B" references a midpoint of a flexing sharp blade 110.

Figure 10:
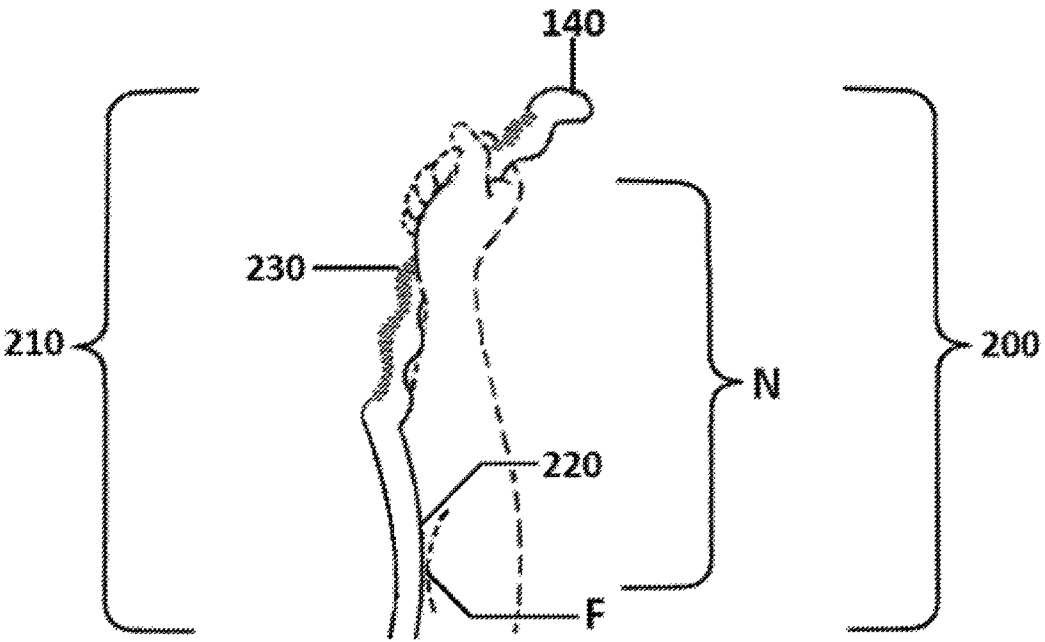
FIG. 10 illustrates a top view of a wrist area of the handle for a user according to embodiments of the present inventions.

FIG. 10 illustrates a top view of a wrist area of an s-shaped elongated member 100 with an inner side 210 and an outer side 200 wherein the inner side 210 is opposite the outer side 200 according to embodiments of the present inventions. A body leverage surface 220 is illustrated in FIG. 10 is pressing into the forearm creating a fulcrum which is referenced as F. The fulcrum F is created when the forearm is pressing against the body leverage surface 220 in order to press the s-shaped elongated member 100 into the back side while the s-shaped elongated member 100 is able to be held firmly in a neutral wrist position during the method of shaving the lower half of the back. As can be seen in FIG. 10 the wrist is positioned and locked into what is referenced as a neutral resting position N. Neutral N is inside a grip end 140 and where the user's forearm is against the body leverage surface 220 on the outer side 200 of the s-shaped elongated handle 100 creating fulcrum F and the forearm is pressing against the body leverage surface 220 the margin which is referenced by N is where the wrist remains in a neutral position. Most handles on the market used to shave one's back do not effectively add the leverage nor the support needed between the forearm, wrist and handle that would prevent wrist and shoulder problems. It is often commonly found within most prior art we see the wrist taking most if not all of the stress necessarily exerted in order to brace and navigate the handle in the many different angles and positions necessary to properly shave one's own back side. Within the prior art a user often experiences wrist flexion and wrist extension. Wrist flexion is when the palm bends towards the forearm while wrist extension is when the palm moves away from the forearm resulting in a decrease of angle. When the wrist is granted access to the several motions that permit overuse we also find another motion of stress which is referred to as pronation and supination of the wrist. Pronation and supination are a pair of unique movements within the forearms and hands, allowing the human body to flip the palm either face up or face down. The muscles, bones, and joints of the human forearm are specifically arranged to permit these unique and noteworthy rotations of the hands. Supination of the forearm occurs when the forearm or palm are rotated outwards. Pronation at the forearm is a rotational movement where the hand and upper arm are turned inwards. Yet another range of motion within the wrist that adds a level of stress is known as radial deviation and ulnar deviation. Radial and ulnar deviation are a pair of movements tilting the wrist from one side to the other. Radial deviation is to move the thumb side of the hand down towards the wrist and ulna deviation is moving the little finger side down. These movements create added stress and may be very difficult for a user who suffers from a wrist syndrome such as Carpal Tunnel Syndrome (CTS) and may often lead to other joint or muscle related issues. Carpal Tunnel Syndrome (CTS) can be associated with any condition that causes pressure on the median nerve at the wrist. Another limiting wrist syndrome is known as Wrist Osteoarthritis which can result is a group of mechanical abnormalities which can result in joint destruction. These abnormalities include degeneration of cartilage and hypertrophic bone changes, which can lead to extreme pain, swelling and loss of function. Another limiting wrist syndrome is known as a scaphoid fracture which is a fracture of the scaphoid bone also known as the carpal navicular. This is the most common type of carpal bone fracture. Scaphoid fractures usually cause pain at the base of the thumb accompanied by swelling in the same area. Scaphoid fractures usually cause pain and sensitivity to palpation in the anatomic snuffbox at the base of the thumb accompanied by swelling in the same area. Fractures of scaphoid can occur either with direct axial compression or with hyperextension of the wrist, such as a fall on the palm on an outstretched hand. Circumduction of the wrist is another common movement used when attempting to reach areas of the back for shaving. Circumduction describes a continuous circular movement of a limb around a joint. Circumduction of the wrist occurs when the wrist joint allows movement of the limb that can scribe a circle in the air. Most muscular movement of the body can be described through the use of circumduction, abduction, adduction, flexion or extension or some combination of the five. The muscles used in circumduction of the wrist are any muscle with origin on the forearm and insertion on phalanges or metacarpals.

Quite the opposite it can be seen in the eighth embodiment in FIG. 10 the forearm is able to secure itself against the body leverage surface 220 in order to lock the wrist into a neutral position preventing the wrist problems discussed herein. Thus, when shaving the lower half of the back from side of torso as well as the top half of the back from over the shoulder both supination and pronation of the forearm is prevented. Since the wrist in the prior art in not allowed to lock itself into a neutral position but rather instead taking on the majority of the stress of balancing the handle as well as the stress of holding the handle at a preferred angle there are areas of stressed placed on the wrist wherein someone who struggles with a wrist problem such as Carpal Tunnel Syndrome (CTS) or perhaps Wrist Osteoarthritis would have a difficult and painful time attempting to use prior handles.

Letter designations in the drawings depict certain planes, gap distances and contours, defined throughout, and for convenience are summarily defined wherein:

"N" references a margin inside a grip end 140 and wherein a user's forearm is creating fulcrum F against the body leverage surface 220 on the outer side 200 of an s-shaped elongated handle 100.

Figure 11:
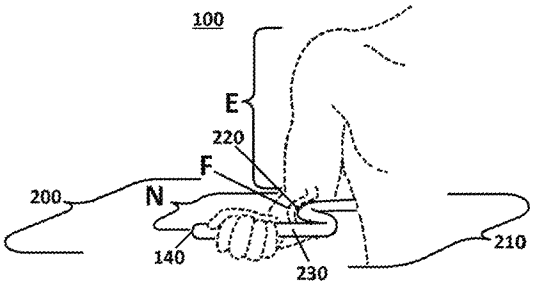
FIGS. 11-13 illustrate front views of user utilizing a handle according to embodiments of the present inventions.
Figure 12:
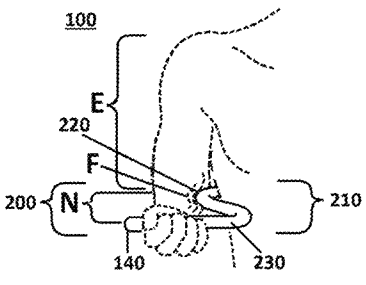
Figure 13:
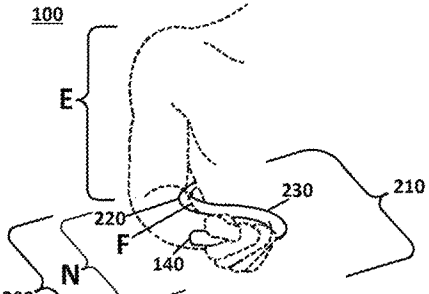
Figure 14:
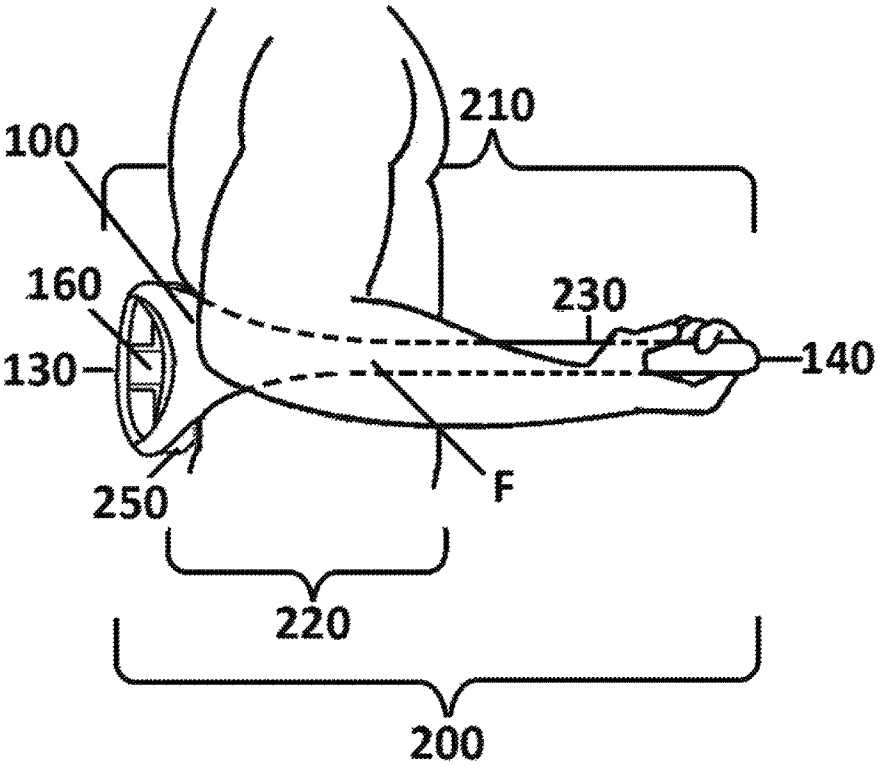
FIGS. 14-16 illustrate side views of a user utilizing a handle according to embodiments of the present inventions.
Figure 15:
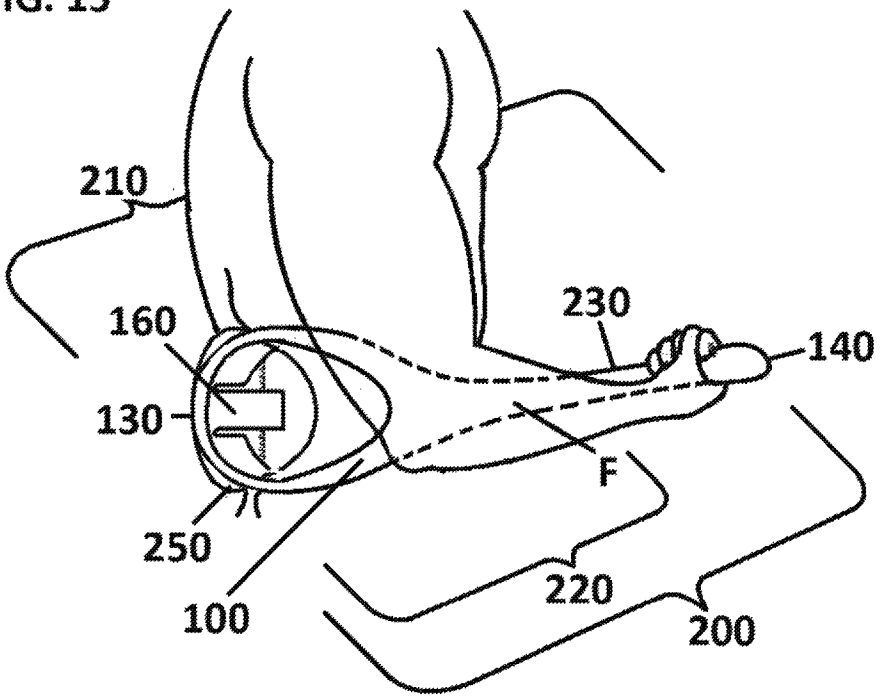
Figure 16:
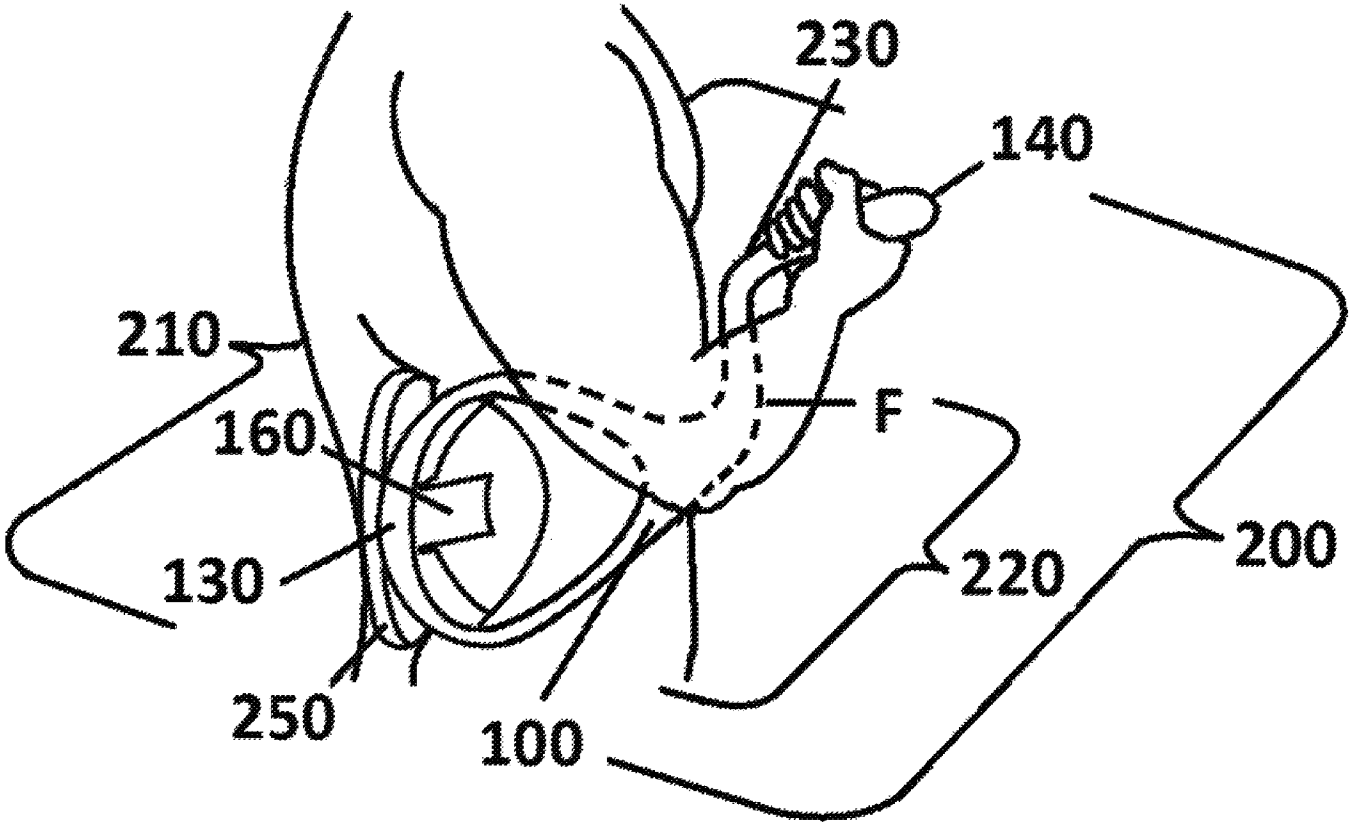

FIGS. 11-13 illustrate front views of user utilizing an s-shaped elongated handle 100 according to embodiments of the present inventions. The handle is a generally s-shaped elongated member 100 having a surface along a length of the s-shaped elongated member 100 and an inner side 210 and an outer side 200 and a grip end 140 and the said outer side 200 opposite the said inner side 210 and between the outer side 200 and the inner side 210 and having a grip 230 located on the inner side of the s-shaped elongated member 100 and the surface of the s-shaped elongated member 100 that is substantially smooth and a cross-sectional shape of the s-shaped elongated member 100 near the midway is substantially smooth having a shape that is substantially round or oval.

A body leverage surface 220 located on the outer side 200 of the elongated member configured to press against a user's forearm when the grip 230 is respectively gripped by fingers and hand by a same arm of the user and the s-shaped elongated member 100 is reaching the blade end under an armpit of the same arm of the user to leverage the blade attachment located on the inner side 210 of the s-shaped elongated member 100 against a torso backside of the user.

A fulcrum F is embodied where the body leverage surface 220 meets with the inside of a user's forearm creating the leverage between the body leverage surface 220 in relation to the grip 230. FIGS. 11-13 are front views of the user carrying out a shaving stroke on the lower half of their back side. The s-shaped elongated member 100 is allowing the user's arm to remain adducted which is represented by E. Adduction E of the arm means "the movement of a limb towards the midline of the axis of the body" as defined by Mosby's Medical Dictionary, 8th edition, 2009, Elsevier.

Adduction E references the adduction taking place inside the user's shoulder and elbow during the shaving stroke. Adduction E references the shoulder and the elbow remaining at an adducted position towards the medial plane of the body and not extending outward in an abducted manner. The opposite of adduction is abduction. Abduction occurs when the arms are held at the sides, parallel to the length of the torso, and are then raised in the plane of the torso. Abduction plays a role in shoulder problems and can increase the level of pain when an individual is experiencing shoulder impingement syndrome. Impingement syndrome is a common cause of shoulder pain. It occurs when there is impingement of tendons or bursa in the shoulder from bones of the shoulder. Abducting the shoulder by using overhead activity of the shoulder, especially repeated activity, is a risk factor for shoulder impingement syndrome. Other risk factors of shoulder impingement syndrome include bone and joint abnormalities. With impingement syndrome, pain is persistent and affects everyday activities. Motions such as reaching up behind the back or reaching up overhead to shave one's own back can cause pain. Over time impingement syndrome can lead to inflammation of the rotator cuff tendons (tendinitis) and bursa (bursitis). If not treated appropriately, the rotator cuff tendons can start to thin and tear." The typical symptoms of impingement syndrome include difficulty reaching up behind the back, pain with overhead use of the arm and weakness of shoulder muscles. Shoulder pain is the third most common cause of musculoskeletal consultation in primary care. One percent (1%) of adults with new shoulder pain consults their GP doctor each year. Self-reported prevalence of shoulder pain is between 16% and 26%. Historically, lateral shoulder pain worsens with positions or activities which put stretch on the glenohumeral joint which progresses to stiffness.

As seen in FIGS. 11-13 and as previously discussed in the prior FIG. 10 the when the wrist is capable of resting and interlocking with the s-shaped elongated member 100 in a neutral position while at the same a user's arm is capable of remaining adducted which together both wrist and arm health problems are prevented. The neutral wrist position N is illustrated in FIG. 11-13 interlocking with the s-shaped elongated member 100 inside of the grip end 140 and the body leverage surface 220. The method in which the wrist and shoulder move are limited when using the s-shaped elongated member 100, prevent both health issues describe herein with the wrist as well as with the shoulder. The neutral wrist position N interlocking with the s-shaped elongated member 100 combined with the body leverage surface 220 located on the outer side 200 of the s-shaped elongated member 100 near a midway between the grip 230 and the blade end 130 and the blade end 130 configured to press the body leverage surface 220 against a user's forearm when the grip 230 is respectively gripped by fingers and hand by a same arm of the user located on the inner side 210 of the s-shaped elongated member 100.

Letter designations in the drawings depict certain planes, gap distances and contours, defined throughout, and for convenience are summarily defined wherein:

"E" references the addiction margin wherein the shoulder and the elbow remaining at an adducted position towards the medial plane of the body and not extending outward in an abducted manner.

FIGS. 14-17 illustrate side views of a user utilizing an s-shaped elongated handle 100 according to embodiments of the present inventions. The handle has a generally s-shaped elongated member 100 having a surface along a length of the s-shaped elongated member 100 with a blade end 130 and a grip end 140 and the blade end 130 opposite the grip 230 and the outer side 200 opposite the said inner side 210, and between the outer side 200 and the inner side 210 and having a grip 230 located on the inner side 210 of the s-shaped elongated member 100 which can be seen in FIG. 16. A handle clip 160 used to lock and release a safety razor 250 and at least a blade group 260 protruding away from the safety razor 250.

An elongated soft cushion or sponge 390 located on the outer side 200 of the s-shaped elongated member 100 and pressing against the inside of a user's forearm where a fulcrum F is illustrated.

A body leverage surface 220 is located on the outer side 200 of the s-shaped elongated member 100 near a midway between the grip 230 and the blade end 130 and the blade end 130 configured to press the body leverage surface 220 against a user's forearm creating a fulcrum F when the grip 230 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment and safety razor 250 located on the inner side 210 of the s-shaped elongated member 100 against a torso backside of the user.

Figure 19:
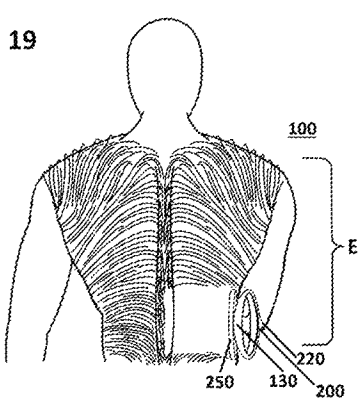
FIGS. 17-19 illustrate rear views of a user utilizing a handle according to embodiments of the present inventions.
Figure 18:
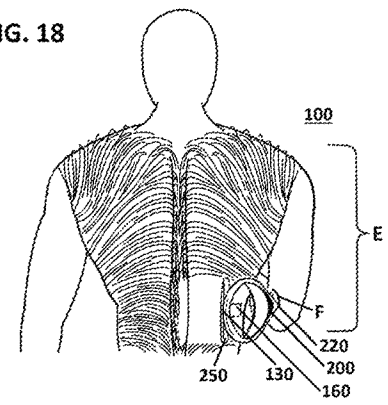
Figure 17:
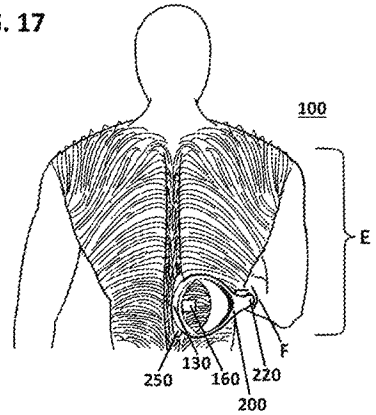

FIGS. 17-19 illustrate rear views of a user utilizing an s-shaped elongated handle 100 according to embodiments of the present inventions. The handle has a generally s-shaped elongated member 100 having a surface along a length of the s-shaped elongated member 100 with a safety razor 250 near a blade end 130 and a handle clip 160. A body leverage surface 220 is located on an outer side 200 of the s-shaped elongated member 100 configured to press against a user's forearm creating fulcrum F when the grip 230 is respectively gripped by fingers and hand by a same arm of the and the s-shaped elongated member 100 is reaching the blade end 130 under an armpit of the same arm of the user to leverage the blade attachment and safety razor 250 of the s-shaped elongated member 100 against a torso backside of the user. It can be seen in FIGS. 17-19 that during a shaving stroke adduction E as illustrated and present allows the prevention of shoulder impingement as well as other shoulder related health issues. During the shaving stroke of the lower half of the back the present method allows the blade end 130 to reach the center of the spinal area which often has a slope or a valley that often proves difficult to perform a task such as a shaving stroke.

A blade end 130 located at an end of the s-shaped elongated member 100 opposite the grip end 140 and the handle clip 160 used to lock and release a safety razor 250. A body leverage surface 220 is located on the outer side 200 of the s-shaped elongated member 100 near a midway between the grip and the blade end 130 and the blade end 130 configured to press the body leverage surface 220 against a user's forearm when the grip is respectively gripped by fingers and hand by a same arm of the user located on the inner side of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment and the safety razor 250 located on the inner side of the s-shaped elongated member 100 against a torso backside of the user. It can be seen that the spinal area would commonly be a difficult area to reach and shave effectively. However, the mechanics of the s-shaped elongated member 100 grant effective access between the spine area and the blade end 130.

Figure 20:
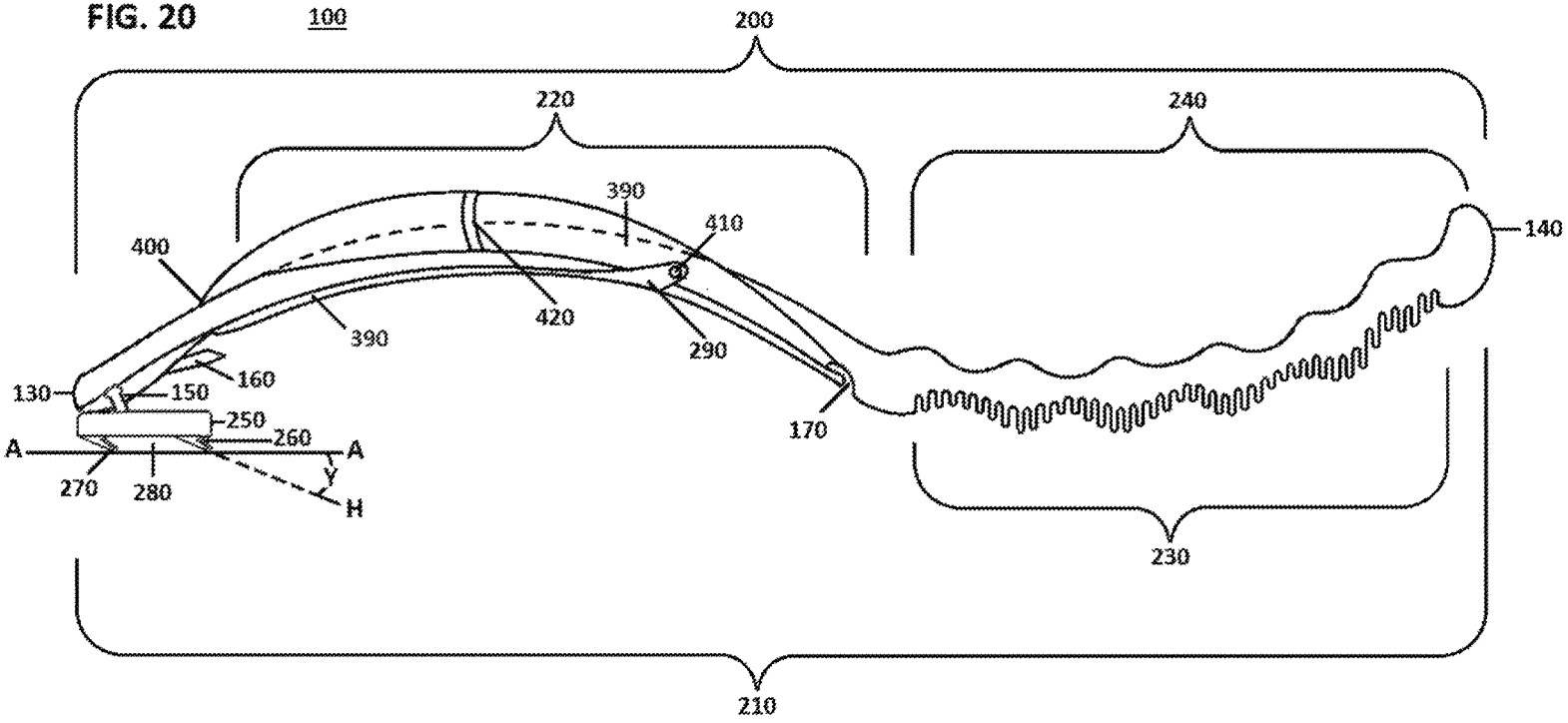
FIG. 20 illustrates a side view of a handle with a soft cushion or sponge according to embodiments of the present inventions.

FIG. 20 illustrates a side view of an s-shaped elongated handle 100 with a soft cushion or sponge 390 according to embodiments of the present inventions. The handle has a generally s-shaped elongated member 100 having a surface along a length of the s-shaped elongated member 100 defining an inner side 210 and an outer side 200 a blade end 130 and a grip end 140 and blade end 130 opposite a grip 230 and the said outer side 200 opposite the said inner side 210, and having a finger surface grip 230 located on the inner side of the s-shaped elongated member 100 and wherein the inner side 210, the outer side 200, the blade end 130, and the grip end 140 join one another to create an outer side 200 surface of the s-shaped elongated member 100 that is substantially smooth and a cross-sectional shape of the s-shaped elongated member 100 near the midway is substantially smooth having a shape that is substantially round or oval and a blade attachment 150 at a blade end 130 of the s-shaped elongated member 100, the blade end 130 located at an end of the s-shaped elongated member 100 opposite the grip end 140, the blade attachment 150 located on the inner side 210 of the s-shaped elongated member 100 and blade attachment 150 comprises a handle clip 160 used to removably attach a safety razor 250 in the said blade attachment 150. The blade attachment 150 attaches to the safety razor 250 with at least a blade group 260 protruding away from the safety razor 250 on the inner side 210 of the s-shaped elongated member 100 facing against the torso backside of the user. FIG. 20 illustrates a plurality of blade groups protruding away from the safety razor 250 which are illustrated as the primary blade group 260 and a secondary blade group 270 and inside of primary blade group 260 and secondary blade group 270 is a sensory gap 280. The safety razor 250 having at least one or more blade group at an angle from the said safety razor 250 and allowing said safety razor 250 the capability of stimulating the mechanoreceptors as well as promoting two-point discrimination. The sensory gap 280 allowing the tips of the blade group 260, the blade group 270 and the safety razor 250 to balance at the correct cutting angle while a sensory gap 280 is inside the blade group 260 and blade group 270. The s-shaped elongated member 100 has a straight length or a length that does not follow the curve of the s-shaped member 100 but rather that actual distance from the blade end 130 to the grip end 140 which is approximately 330 mm to 457.2 mm. A preferred straight length of the s-shaped member 100 is approximately 355.6 mm.

A body leverage surface 220 is located on the outer side 200 of the s-shaped elongated member 100 near a midway between the grip 230 and the blade end 130 and the blade end 130 configured to press the body leverage surface 220 against a user's forearm when the grip 230 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the blade attachment 150 located on the inner side 210 of the s-shaped elongated member 100 against a torso backside of the user.

A hook 170 in FIG. 20 takes the shape of a slit on the inner side 210 of the s-shaped elongated member 100. There may be multiple hooks 170 embodied on the s-shaped elongated member 100. Hook 170 may also be embodied on the outer side 200 of the s-shaped elongated member 100. In another alternate embodiment the hook 170 may also take the form of at least one protrusion that protrudes from the outer side 200 of the s-shaped elongated member 100 or from the inner side 210 of the s-shaped elongated member 100 allowing a sponge 390 to attach. Aside from being a slit, a hook 170, in another embodiment, may also take the form of a loop fastener, a snap button 410 or another alternative method to anchor a portion of the elongated sponge 390 to the s-shaped elongated member 100 while a strap 290 comprised by the s-shaped elongated member 100 near the body leverage surface 220 allows the elongated sponge 390 to adhere to the s-shaped elongated member 100. Although my invention may only need one anchor to function properly there are multiple anchors illustrated in FIG. 20. Hook 170 is utilized in holding the inner side 210 of the elongated sponge 390 closest to the grip 230. The hook 170 may be positioned closer in proximity or further away in proximity to the blade end 130. A folding anchor 400 serves a purpose of holding the end of the elongated sponge 390 closest to the blade end 130. The snap button 410 is illustrated fastening the strap 290 of the elongated sponge 390. Folding anchor 400 is where the sponge 390 may anchor and fold itself in order to have a portion of the elongated sponge 390 along the inner side 210 of the s-shaped elongated member 100 and a portion of the elongated sponge 390 along the outer side 200 of the s-shaped elongated member 100. In another embodiment the elongated sponge 390 may anchor itself only on the outer side 200 of the s-shaped elongated member 100. The hook 170, folding anchor 400 and strap 290 may be may be positioned in closer proximity or further away in proximity to the blade end 130. A pocket 420 is illustrated in FIG. 20 and embodied on said elongated sponge 390 in order to allow a user the option to harness a solid bar of soap inside of said elongated sponge 390 in order to create a lather when applying water and stroking the elongated sponge 390 against the backside. A midpoint H of the safety razor 250 is at an angle in relation to the skin plane A referenced as angle Y. Angle Y is preferred to be approximately 20 degrees. Also a secondary grip illustrated as grip 240 is on the outer side 200 of the s-shaped elongated handle 100 inside the of the grip end 140 and the body leverage surface 220. The blade attachment 150 is a portion of the s-shaped elongated member 100 near the blade end 130 that attaches to an attachment on the safety razor 250. In order for the blade attachment 150 to properly function there is also an attachment on the safety razor 250 for the s-shaped elongated member 100 to attach itself to. The blade attachment 150 and a attaching piece on the safety razor 250 may take many different forms to allow both safety razor 250 and elongated member 100 to removably attach with one another.

Figure 21:
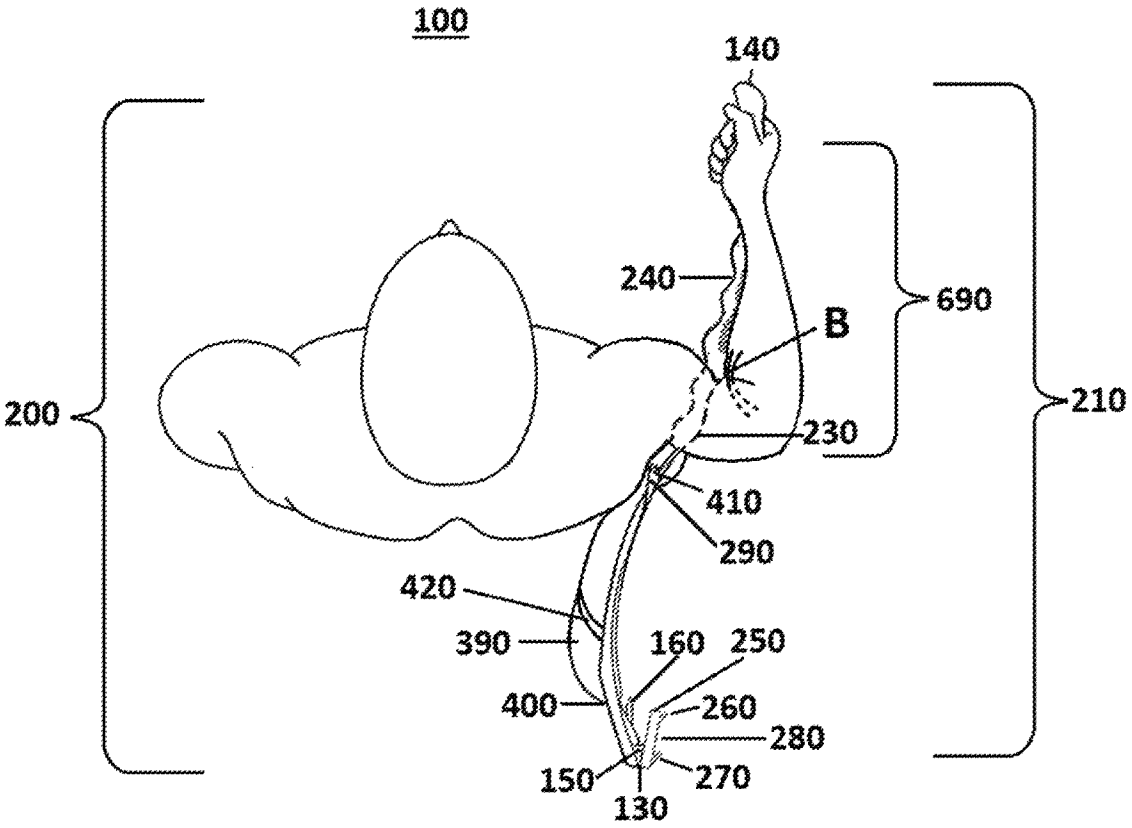
FIGS. 21-23 illustrate aerial views of an s-shaped elongated handle and a sequence of a method of the s-shaped elongated member pressing an elongated sponge attached to the body leverage surface according to embodiments of the present inventions.
Figure 22:
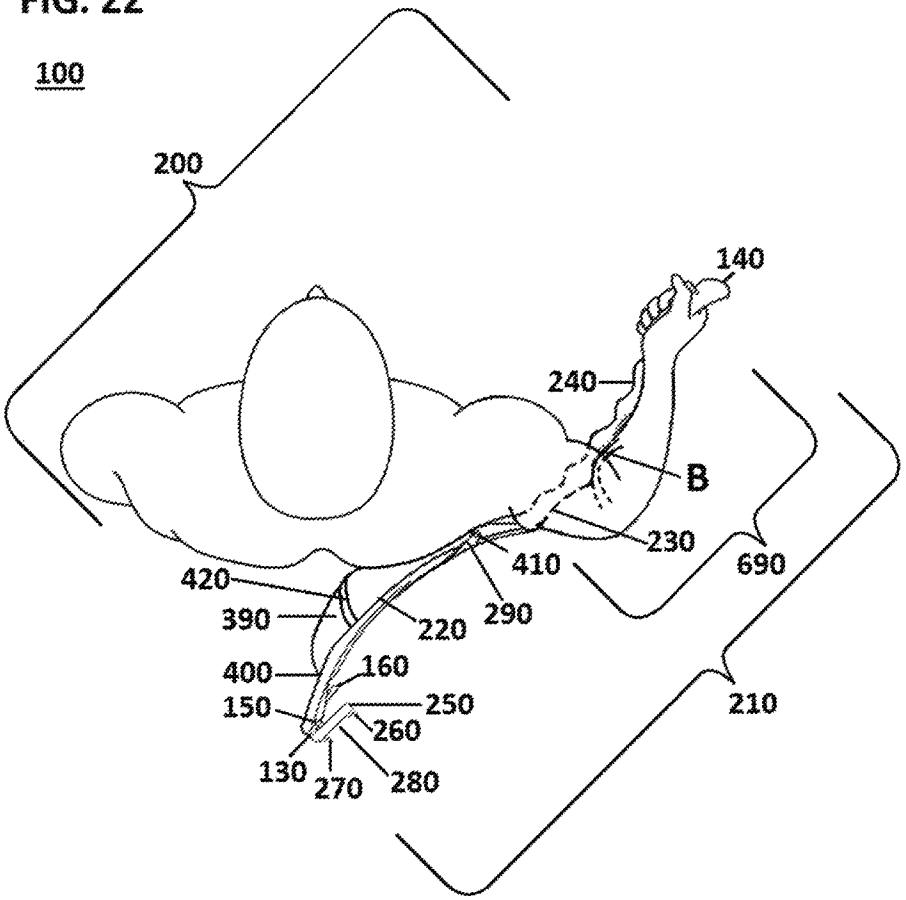
Figure 23:
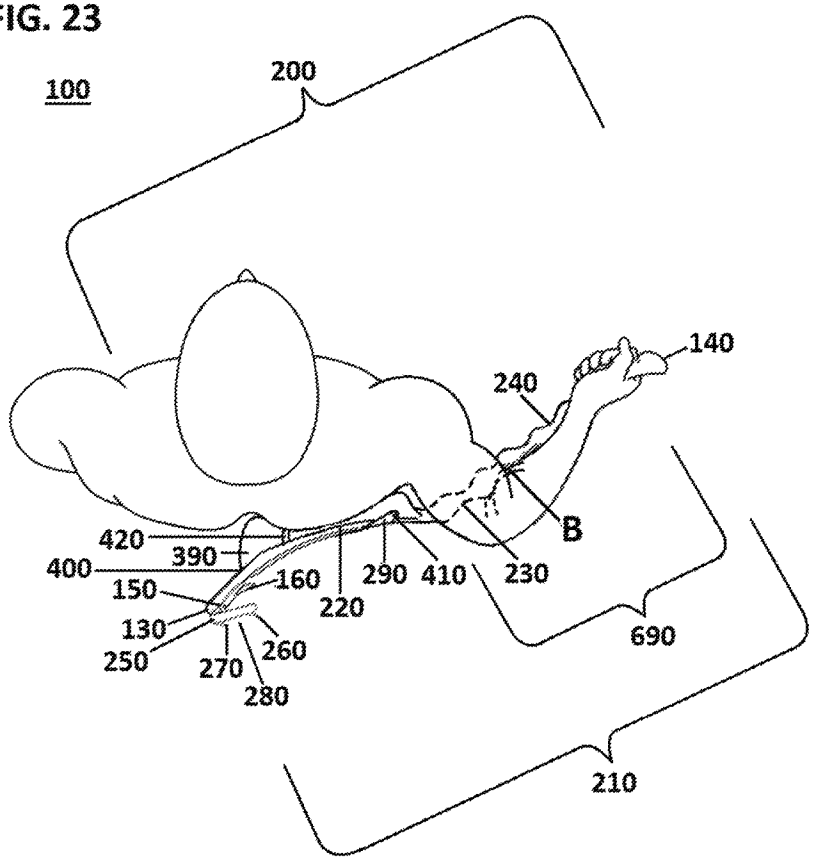

FIGS. 21-23 illustrate aerial views of an s-shaped elongated handle and a sequence of a method of the s-shaped elongated member pressing an elongated sponge attached to the body leverage surface according to embodiments of the present inventions. The s-shaped elongated handle 100 is removably attached to a soft cushion or elongated sponge 390 gripped by a user extended under the armpit towards the backside according to embodiments of the present inventions. The handle has an s-shaped elongated member 100 with the soft cushion or elongated sponge 390 where the inner side 210 of the s-shaped elongated member 100 presses against a user's forearm arm and establishing a secondary fulcrum illustrated as fulcrum B. In FIGS. 21-23 a secondary grip 240 with finger depressions is illustrated on the inner side 210 of the elongated s-shaped elongated member 100. As illustrated in FIGS. 21-23 the s-shaped elongated member 100 has been flipped or reversed from the previously illustrated FIGS. 4-7 and FIGS. 10-19 and in FIG. 21-23 creating a fulcrum B is relative to the grip 240 to press the elongated sponge 390 against the torso backside of the user In the previous FIGS. 4-7 and FIGS. 10-19 the fulcrum F is illustrated and is relative to the grip 230 to press the blade end 130 opposite the grip end 140 towards the torso backside of the user and stroking the blade end 130 against the torso backside of the user. As illustrated in FIGS. 21-23 the s-shaped elongated member 100 has been flipped or reversed and a fulcrum B is relative to the grip 240 to press the elongated sponge 390 against the torso backside of the user. A secondary body leverage surface 690 is located on the inner side 210 of the s-shaped elongated member 100 near a midway between the grip end 140 and the elongated sponge 390 configured to press the secondary body leverage surface 690 against a user's forearm and creating fulcrum B when the grip 240 is respectively gripped by fingers and hand by a same arm of the user located on the inner side 210 of the s-shaped elongated member 100 a thumb of the hand facing away from the blade end 130 of the s-shaped elongated member 100 and the s-shaped elongated member 100 is reaching the blade end 130 under an armpit of the same arm of the user to leverage the elongated sponge 390 located on the outer side 200 of the s-shaped elongated member 100 against a torso backside of the user. A folding anchor 400 serves a purpose of holding the end of the elongated sponge 390 closest to the blade end 130. The snap button 410 is illustrated fastening the strap 290 of the elongated sponge 390. A pocket 420 is illustrated in FIG. 20 and embodied on said elongated sponge 390 in order to allow a user the option to harness a solid bar of soap inside of said elongated sponge 390 in order to create a lather when applying water and stroking the elongated sponge 390 against the backside.

The s-shaped elongated member 100 having a flexible sponge 390 having a plurality of anchors capable of holding a skin care product when the user reverses the fingers and the hand at the grip 240 and so the fingers are located opposite the finger surface grip 230 and the s-shaped elongated member 100 is reaching the elongated sponge 390 against a torso backside of the user. The s-shaped elongated member 100 elongated sponge 390 or cushion near the body leverage surface 220 capable of holding a skin care product when the user reverses the fingers and the hand at the grip 230 and so the fingers are located opposite the finger surface at a secondary grip 240 and the s-shaped elongated member 100 is reaching the elongated sponge 390 or cushion attachment against a torso backside of the user. Said elongated sponge 390 or cushion attachment has a strap 290 for attaching the skin care product to the s-shaped elongated member 100.

FIGS. 21-23 illustrate a sequence of a method of an s-shaped elongated member pressing an elongated sponge attached to the body leverage surface according to embodiments of the present inventions. It can be seen in FIGS. 21-23 a user is gripping a hand on a grip 240 at a handle of a generally s-shaped elongated member 100 having a surface along a length of the s-shaped elongated member 100 defining an inner side 210 and an outer side 200 a blade end 130 and a grip end 140 wherein the blade end 130 opposite the grip end 140 the outer side 200 opposite the inner side 210 and a blade attachment 150 at a blade end 130 of the s-shaped elongated member 100, the blade end 130 located at an end of the s-shaped elongated member 100 opposite the grip end 140, the blade attachment 150 located on the inner side of the s-shaped elongated member 100 and where gripping fingers of the hand on a finger surface located on the inner side 210 of the s-shaped elongated member 100. The blade attachment 150 comprises a handle clip 160 used to lock and release a safety razor 250 in the said blade attachment 150. In FIG. 21-23 the safety razor 250 having a primary blade group 260 and a secondary blade group 270 of which are at an angle from the said safety razor 250 and a port of a safety razor 250 inside of a blade group 260 and blade group 270 removed and creating a sensory gap 280 inside of primary blade group 260 and secondary blade group 270.

In FIGS. 21-23 a user is gripping s-shaped elongated member 100 with a thumb of the hand facing away from the blade end 130 of the s-shaped elongated member 100 and a user grasping a finger surface grip 240 and pressing a forearm against secondary body leverage surface 690 located on the inner side 210 of the s-shaped elongated member 100 near a midway between the grip 230 and the grip end 140 and configured to press the body leverage surface 220 against a user's backside when the finger surface and grip end 140 are respectively gripped by fingers and hand by a same arm of the user and positioning the s-shaped elongated member 100 under an armpit of the user reaching the body leverage surface 220 under an armpit of the same arm of the user to leverage elongated sponge 390 located on the outer side 200 of the s-shaped elongated member 100 against a torso backside of the user.

In FIGS. 21-23 the sequence of the method of an s-shaped elongated member 100 presses the elongated sponge 390 attached to the body leverage surface 220 and is curved such that it meshes with a curve of the body leverage surface 220 on the outer side of the s-shaped elongated member 100 near the midway between the grip and the blade attachment. In FIGS. 21-23 a user is reversing the fingers and the hand at the grip end 140 so the fingers are located opposite the finger surface 230 and attaching a strap 290 with a snap button 410 comprised by the flexible elongated sponge 390 to the s-shaped elongated member 100 near the body leverage surface 220 to adhere the sponge 390 to the s-shaped elongated member 100 the s-shaped elongated member 100 reaches the soft sponge 390 against a torso backside of the user and the flexible elongated sponge 390 has characteristics capable of holding a skin care product for application to the torso backside of the user and s-shaped elongated member 100.

Figure 24:
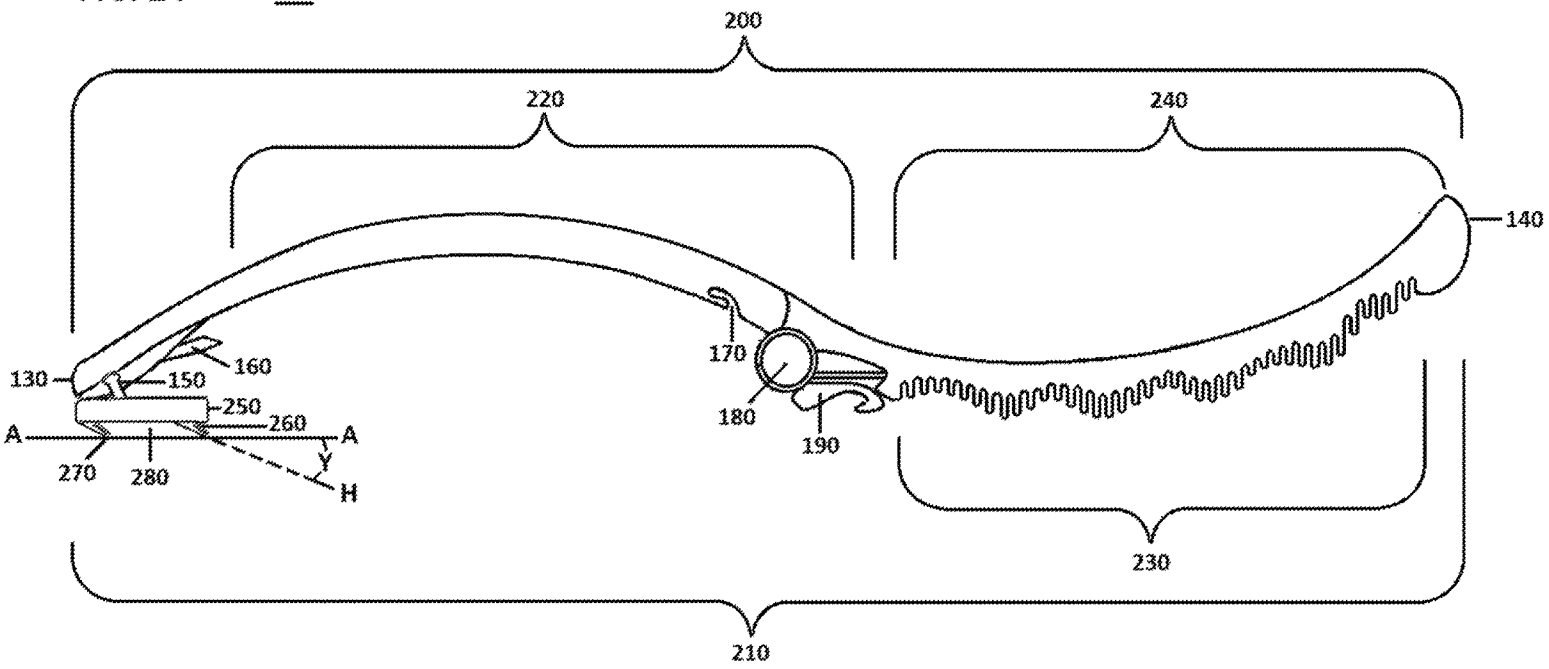
FIG. 24 illustrate a side view of an s-shaped elongated handle according to embodiments of the present inventions.

FIG. 24 illustrates a side view of an s-shaped elongated handle 100 according to embodiments of the present inventions. The handle has a generally s-shaped elongated member 100 having a surface along a length of the s-shaped elongated member 100 defining an inner side 210 and an outer side 200 a wherein the said outer side 200 opposite the said inner side 210, and the grip end 140 opposite the blade end 130 and between the outer side 200 and the inner side 210 and having a grip 230 comprising a finger surface 230 located on the inner side 210 of the s-shaped elongated member 100 and a grip 240 located on the outer side 200 of the s-shaped elongated member 100 and wherein the inner side 210, the outer side 200, the blade end 130, and the grip end 140 join one another to create an outer side 200 surface of the s-shaped elongated member 100 that is substantially smooth and a cross-sectional shape of the s-shaped elongated member 100 near the midway is substantially smooth having a shape that is substantially round or oval. The s-shaped elongated member 100 has a straight length or a length that does not follow the curve of the s-shaped member 100 but rather that actual distance from the blade end 130 to the grip end 140 which is approximately 330 mm to 457.2 mm. A preferred straight length of the s-shaped member 100 is approximately 355.6 mm.

A hinge 180 and a finger trigger 190 near the midway of the s-shaped elongated member 100 between the grip 230 and the blade attachment 150 are configured to fold the s-shaped elongated member 100 and a finger trigger 190 located near a hinge 180. The hinge 180 moves to fold the s-shaped elongated member 100 back against itself for storage and the hinge 180 moves approximately 180 degrees to completely fold the s-shaped elongated member 100 back against itself for storage and reduce a length of the s-shaped elongated member 100 by approximately half.

A hook 170 in FIG. 24 takes the shape of a slit on the inner side 210 of the s-shaped elongated member 100. There may be multiple anchors embodied on the s-shaped elongated member 100.

A blade attachment 150 is located at a blade end 130 of the s-shaped elongated member 100, the blade end 130 located at an end of the s-shaped elongated member 100 opposite the grip end 140. The blade attachment 150 is located on the inner side 210 of the s-shaped elongated member 100 and blade attachment 150 comprises a handle clip 160 used to lock and release a safety razor 250 in the said blade attachment 150. In FIG. 24 the safety razor 250 having a primary blade group 260 and a secondary blade group 270 at an angle from the said safety razor 250 and a sensory gap 280 inside of primary blade group 260 and secondary blade group 270 and safety razor 250 capable of stimulating the mechanoreceptors as well as promoting two-point discrimination. The blade attachment 150 is a portion of the s-shaped elongated member 100 near the blade end 130 that attaches to an attachment on the safety razor 250. In order for the blade attachment 150 to properly function there is also an attachment on the safety razor 250 for the s-shaped elongated member 100 to attach itself to. The blade attachment 150 and a attaching piece on the safety razor 250 may take many different forms to allow both safety razor 250 and elongated member 100 to removably attach with one another.

A body leverage surface 220 is located on the outer side 200 of the s-shaped elongated member 100 near a midway between the primary grip 230 and the blade attachment 150 configured to press the body leverage surface 220 against a user's forearm when the grip 230 is respectively gripped by fingers and hand by a same arm of the user and the s-shaped elongated member 100 is reaching the blade end 130 under an armpit of the same arm of the user to leverage the blade attachment 150 located on the inner side 210 of the s-shaped elongated member 100 against a torso backside of the user.

Figure 26:
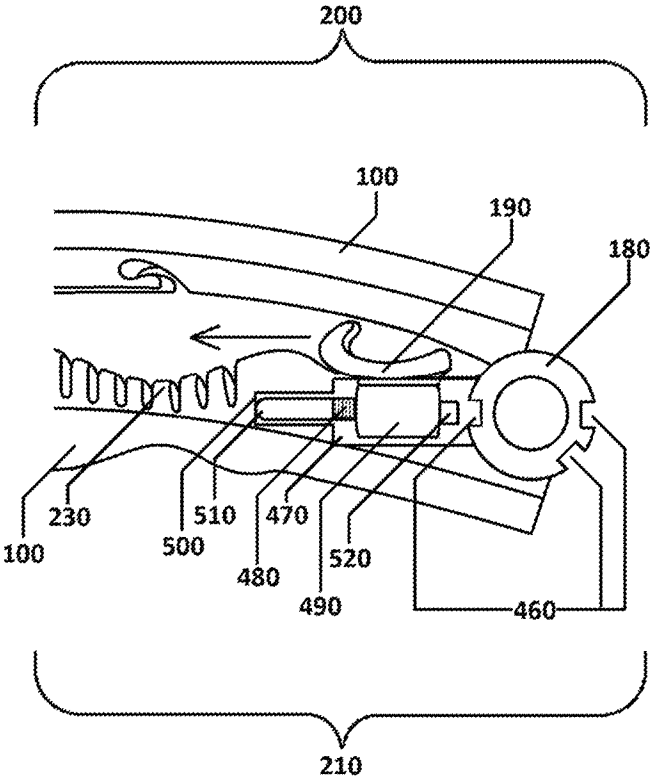
FIGS. 25-26 illustrate a cutaway of a side view of constituent parts of a handle and finger trigger hinge according to embodiments of the present inventions.
Figure 25:
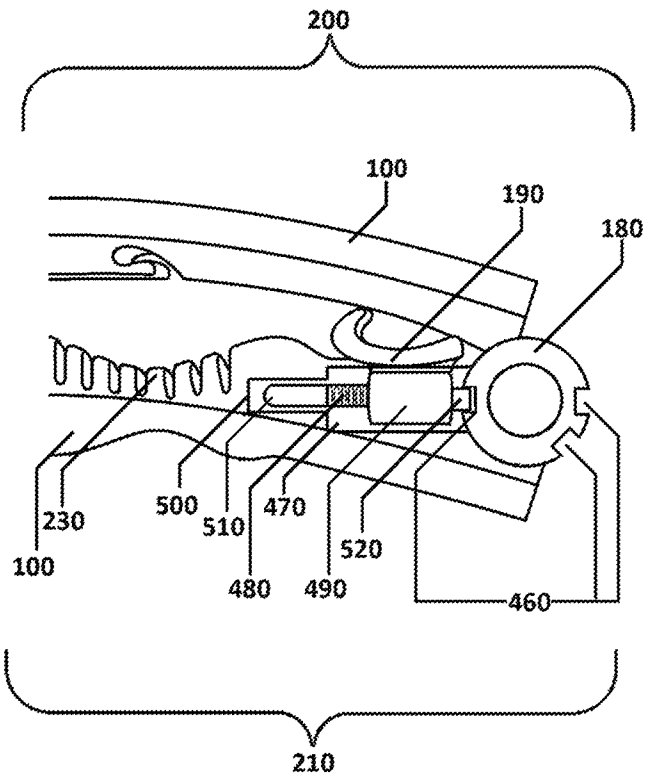

FIGS. 25-26 illustrate a cutaway of a side view of constituent parts of a handle according to embodiments of the present inventions. A hinge 180 and a finger trigger 190 near the midway of the s-shaped elongated member 100 between the grip 230 and a hinge 180 configured to fold the s-shaped elongated member 100 at approximately 180 degrees against itself. The finger trigger 190 located near a hinge 180 and connected with a plunger 490. The hinge 180 moves to fold the s-shaped elongated member 100 back against itself for storage and the hinge 180 moves approximately 180 degrees to completely fold the s-shaped elongated member 100 back against itself for storage and reduce a length of the s-shaped elongated member 100 by approximately half. The hinge 180 having several female slots 460 embodied on the outside rim of the hinge 180. The finger trigger 190 works together with the hinge 180 to allows the s-shaped elongated handle 100 the fold itself and interlock itself into a preferred angled position. The finger trigger 190 coupled with a plunger 490 having a peg 520 and an plunger 490 outside end 510 designed to move back and forth laterally inside of a container 470 by method of a flexible spring 480 implemented to allow the back and forth lateral movement. FIG. 25 illustrates a finger trigger 190 in an uninterrupted position wherein we see a flexible spring 480 retracted and a peg 520 of said plunger 490 is inside of a female slot 460 and keeping hinge 180 s-shaped elongated handle 100 in a temporarily locked position. In FIG. 25 the finger trigger 190 coupled with a plunger 490 having a peg 520 and an outside end 510 designed to move back and forth laterally inside of a container 470 by method of a flexible spring 480. As seen in FIG. 26 when finger trigger 190 is pressed by a user with force horizontally away from a hinge 180, which is indicated with the arrow shown pointing the in the direction away from a hinge 180, we see a peg 520 of a plunger 490 is able to remove itself from a female slot 460 and compressing the flexible spring 480 and bringing the plunger 490 outside end 510 closer in proximity to the container outside end 500. In FIG. 26 the user may now unfold the two-sided s-shaped elongated handle 100. In FIG. 26 the hinge 180 may now move approximately 180 degrees in order to fold the s-shaped elongated member 100 back against itself for storage and to reduce a length of the s-shaped elongated handle 100. A user may activate the finger trigger 190 by pulling or pushing or in some instances the finger trigger 190 may be a push-button as will be illustrated in FIG. 27-30.

Figure 28:
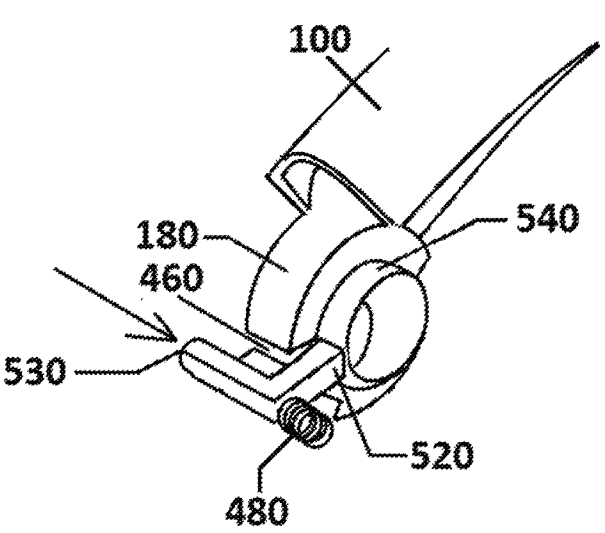
FIGS. 27-28 illustrate close up angled views of a handle and push-button trigger hinge according to embodiments of the present inventions.
Figure 27:
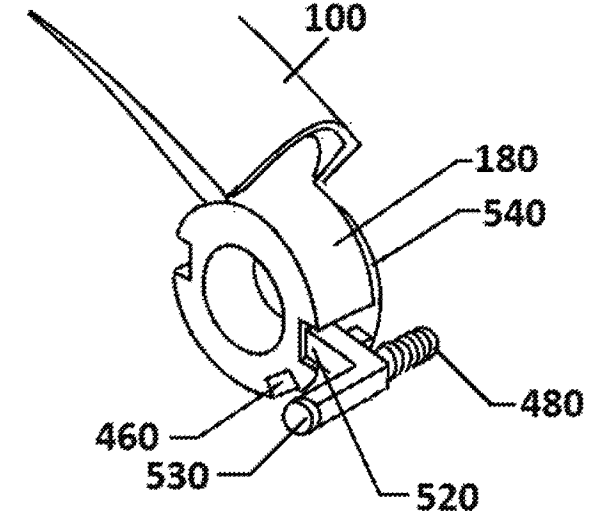

FIGS. 27-28 illustrate close up angled views of a hinge 180 wherein a user may push a push-button 530 in place of a finger trigger 190 which was illustrated in the previous FIGS. 25-26. The push-button 530 is pushed by method of a flexible spring 480 in order to move a peg 520 out of the female slot 460 and into an open channel 540 allowing the hinge 180 to move a peg 520 into an open channel 540 and moving the hinge 180 approximately 180 degrees to completely fold the s-shaped elongated handle 100 back against itself for storage and to reduce a length of the s-shaped elongated handle 100.

Figure 29:
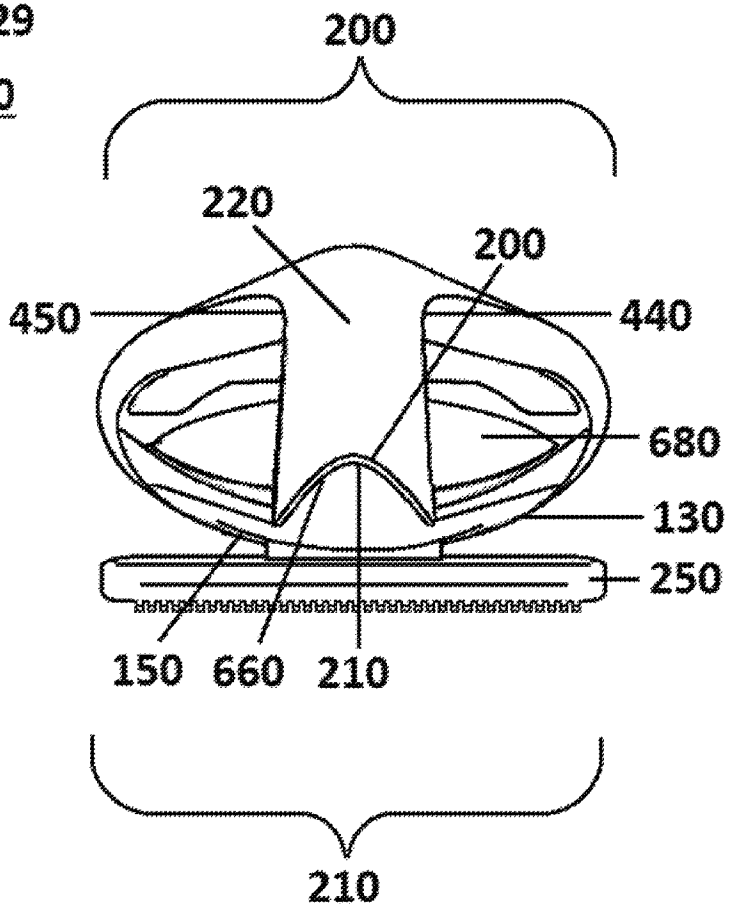
FIGS. 29-30 illustrate rear view cutaway views of a two-sided s-shaped elongated handle having a surface along a length of the s-shaped elongated member according to embodiments of the present inventions.
Figure 30:
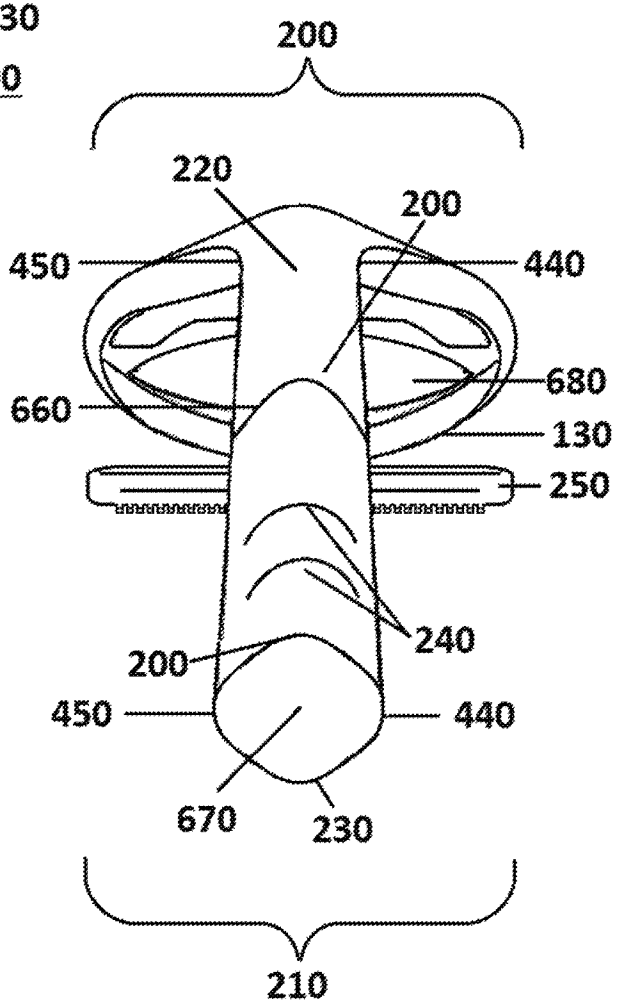

FIGS. 29-30 illustrate rear view cutaway views of a two-sided s-shaped elongated handle 100 having a surface along a length of the s-shaped elongated member 100 defining a left side 440 and a right side 450 a blade end 130 and the left side 440 opposite the right side 450 and the blade end 130 between the left side 440 and right side 450. A safety razor 250 is not included when referencing the left side 440 and the right side 450 of the two-sided s-shaped elongated member 100.

The generally s-shaped two-sided s-shaped elongated member 100 may have a concave shape 660 inside of the blade end 130 and grip 230 which was previously illustrated in the prior FIGS. 1-7 and FIGS. 10-16. In FIG. 29 the concave shape 660 allows for the grip 230 portion of the s-shaped elongated handle 100 to enter in the concave shape 660 when the s-shaped elongated handle 100 is folding against itself at approximately 180 degrees which will be further illustrated in the upcoming FIGS. 31-33. This is beneficial when the two-side s-shaped elongated handle 100 is folded against itself and is easier for a user to grasp said s-shaped elongated handle 100 when being used to shave easy-to-reach areas of the body such as the shoulder, chest or buttock area. Accessing this shoulder area in this manner will be further illustrated in the upcoming FIG. 34. As seen in FIGS. 29-30 a safety razor 250 attaching to the s-shaped elongated handle 100 with a blade attachment 150. A member elongated member opening 680 in the s-shaped elongated handle 100 inside the blade end 130 and a body leverage surface 220. In FIG. 30 a concave shape 660 is inside a blade end 130 and a grip 240 and a cutaway near midway the s-shaped elongated handle 100 illustrating a solid shape 670 inside of the concave shape 660 and a grip end 140 which was illustrated in the prior FIGS. 1-7 and FIGS. 10-16. In the embodiment in FIG. 30 the s-shaped elongated handle 100 solid shape 670 illustrated with a cutaway of the solid shape 670 in order to have a stronger s-shaped elongated handle 100 when applying significant force.

Figure 31:
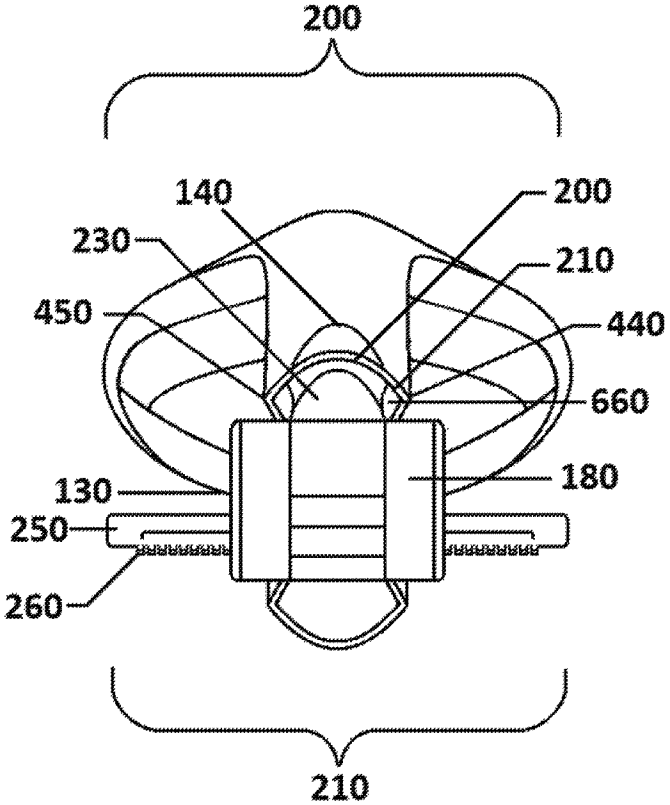
FIG. 31 illustrates a rear view of a two-sided back shaver 100 folded against itself according to embodiments of the present inventions.

FIG. 31 illustrates a rear view of a two-sided back shaver 100 folded against itself and defining a left side 440 and a right side 450 an inner side 210 and an outer side 200, wherein left side 440 opposite a right side 450 and inner side 210 opposite an outer side 200 and a blade end 130 wherein the blade end 130 is between the left side 440 and right side 450. A safety razor 250 is not included when referencing the left side 440 and the right side 450 of an s-shaped elongated member 100. An outer side 200 opposite the said inner side 210, and having a finger surface grip 230 that when said two-sided handle 100 is folded against itself said grip 230 is located on the inner side 210 of the two-sided handle 100 and wherein the inner side 210, the outer side 200, the blade end 130, and the handle end 140 join one another to create an outside surface of the elongated member 100. A safety razor 250 with a blade group 260 located at the blade end 130. Since the two-side handle 100 is folded against itself in FIG. 31 the grip end 140 is directed towards the blade end 130. It can be seen in FIG. 31 that since s-shaped elongated member 100 is folded against itself a grip 230 is inside of s-shaped elongated member 100 concave shape 660.

Figure 32:
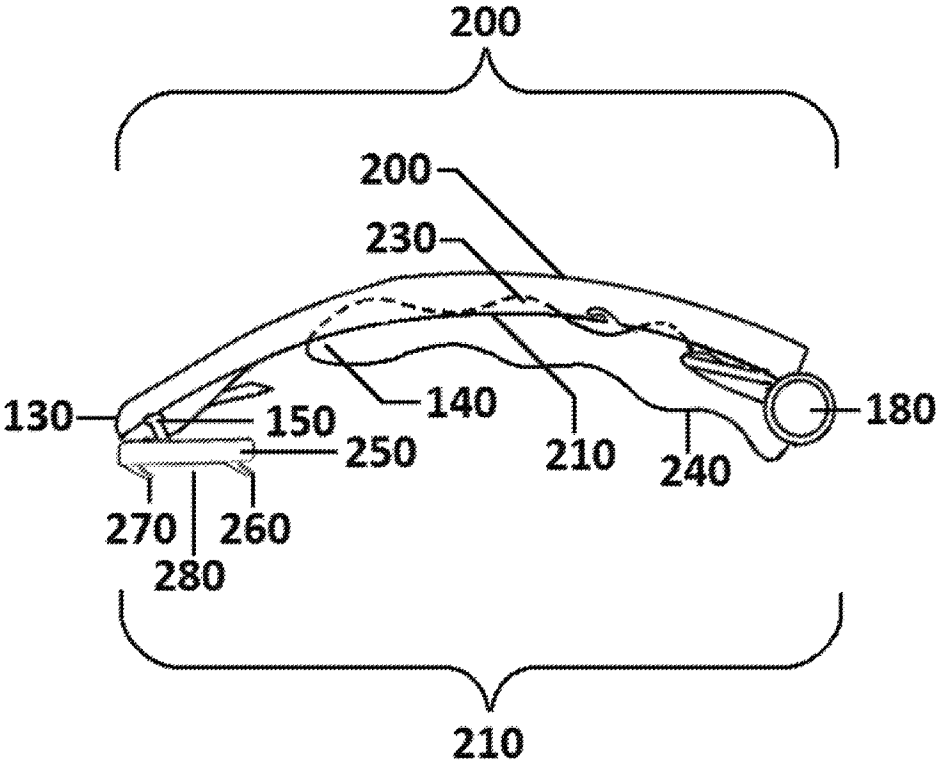
FIG. 32 illustrates a side view of an s-shaped elongated member folded against itself according to embodiments of the present inventions.

FIG. 32 illustrates a side view of an s-shaped elongated member 100 folded against itself and defining an inner side 210 and outer side 200 wherein inner side 210 is opposite outer side 200 and a blade end 130 and a blade attachment 150 near blade end 130 and said blade attachment 150 attaching a safety razor 250 having a blade group 260 and a blade group 270 and a sensory gap 280 inside of the blade group 260 and blade group 270. It can be seen in FIG. 32 that when the s-shaped elongated member is folded against itself a grip 230 is inside of the s-shaped member 100 which is inside of a hinge 180 and the blade end 130. In FIG. 32 hinge 180 having a push button 550. Furthermore, in FIG. 32 it can be seen that a 140 is now directed towards a blade end 130. A secondary grip 240 is now directed towards the inner side 210 of the folded generally s-shaped elongated member 100 allowing a user to easily hold the folded elongated member 100 to shave other easy-to-reach areas of the body which will be further illustrated in the upcoming FIGS. 33-34.

Figure 33:
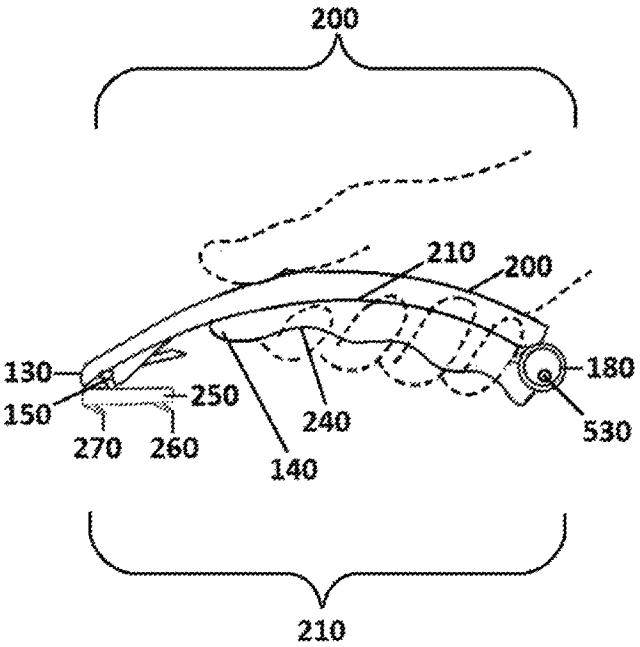
FIG. 33 illustrates a side view of a user holding a folded two-sided handle according to embodiments of the present inventions.

FIG. 33 illustrates a side view of a user holding an s-shaped elongated member 100 folded against itself and defining an inner side 210 and outer side 200 wherein inner side 210 is opposite outer side 200 and a blade end 130 and a blade attachment 150 near blade end 130 and said blade attachment 150 attaching a safety razor 250 having a blade group 260 and a blade group 270. A user's hand is represented with the dashed lines. It can be seen in FIG. 33 that since the s-shaped elongated member 100 is folded against itself a grip 230 is now inside of the s-shaped member 100 and inside of a hinge 180 and the blade end 130. In FIG. 33 a hinge 180 has a push-button 530. Furthermore, in FIG. 33 it can be seen that a grip end 140 is now directed towards a blade end 130. A secondary grip 240 is now directed towards the inner side 210 of the folded s-shaped elongated member 100 allowing a user to easily hold the folded handle 100 to shave other easy-to-reach areas of the body.

Figure 34:
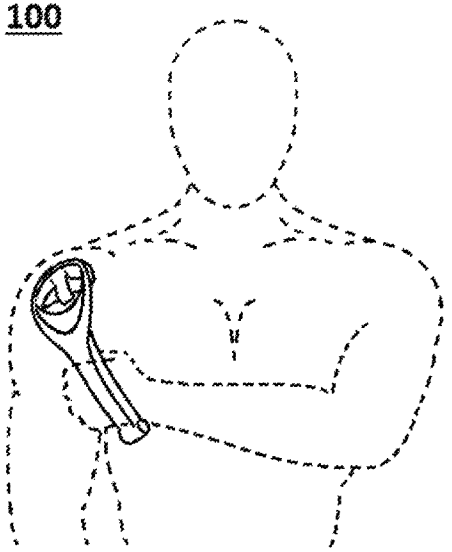
FIG. 34 illustrates a view of a user using the folded two-sided handle of FIG. 33 according to embodiments of the present inventions.

FIG. 34 illustrates a view of a user using the folded two-sided handle of FIG. 33 according to embodiments of the present inventions. The illustration presented in FIG. 34 is to show how a user's hand would grab a folded s-shaped elongated member 100 in order to utilized the s-shaped member 100 for areas of the body that are easier to access than the backside. Fingers belonging to a user are fitted into a secondary grip 240 which is on the inner side 210 of the s-shaped member 100 when said s-shaped member 100 is folded against itself as in FIG. 33. The user's hand is illustrated holding a folded s-shaped elongated member 100 in order to utilize the s-shaped member 100 for areas of the body that are easier to access than the backside. Fingers belonging to a user are fitted into a secondary grip 240 which is on the inner side 210 of the s-shaped member 100 when said s-shaped member 100 is folded against itself as in FIG. 33.

Figure 35:
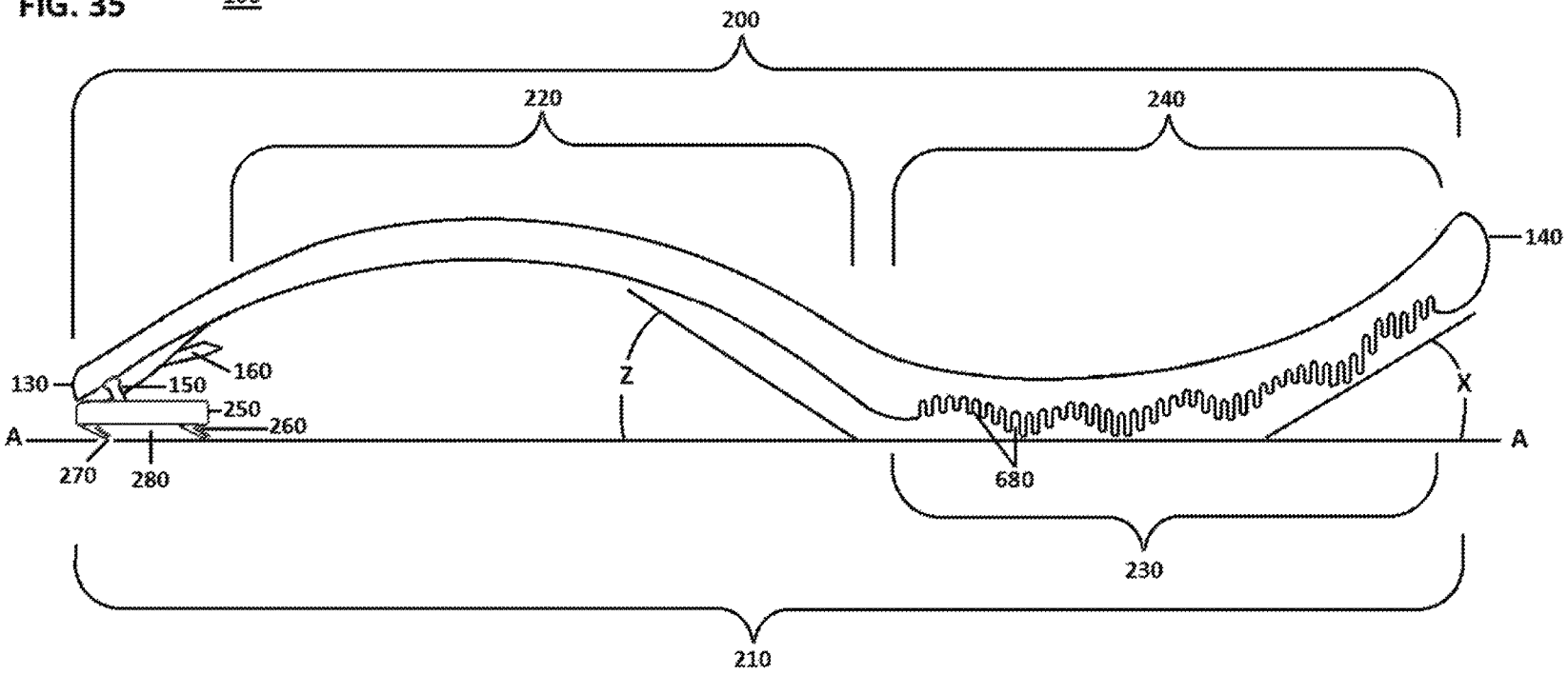
FIG. 35 illustrates a side view of a back shaver s-shaped elongated handle and safety razor with handle angles illustrated relative to a skin plane according to embodiments of the present inventions.

FIG. 35 illustrates a side view of a back shaver s-shaped elongated handle 100 and safety razor 250 with handle angles X and Z illustrated relative to a skin plane A according to embodiments of the present inventions. The handle has a generally s-shaped elongated member 100 having a surface along a length of the s-shaped elongated member 100 defining an inner side 210 and an outer side 200 a blade end 130 and a grip end 140 and blade end 130 opposite the grip 230 and the said outer side 200 opposite the said inner side 210, and having a finger surface grip 230 located on the inner side 210 of the s-shaped elongated member 100 and the inner side 210, the outer side 200, the blade end 130, and the grip end 140 join one another to create an outer side 200 of the s-shaped elongated member 100 that is substantially smooth and a cross-sectional shape of the s-shaped elongated member 100 near the midway is substantially smooth having a shape that is substantially round or oval and a blade attachment 150 at the blade end 130 of the s-shaped elongated member 100 opposite the grip end 140. The blade attachment 150 located on the inner side 210 of the s-shaped elongated member 100 and blade attachment 150 comprises a handle clip 160 used to lock and release a safety razor 250 in the blade attachment 150. The blade group 260 and blade group 270 having tips creating the angle of the sharp blade 110 in relation to a flat skin plane A.

Handle angle X is the angle between a planar skin plane A and an approximated tangent to a curve of the inner side 210 of the finger surface grip 230 near the grip end 140 of the s-shaped elongated handle illustrated in FIG. 35. Mid angle Z is an angle between the planar skin plane A and an approximated tangent to the curve of the inner side 210 of the body leverage surface 220 of the s-shaped elongated handle near a midway of the handle as illustrated in FIG. 35. The mid angle Z and the handle angle X are substantially the same and about slightly less than 45 degrees in one preferred embodiment as illustrated.

Although the invention is described herein with reference to specific embodiments, various modifications and changes can be made without departing from the scope of the present inventions as set forth in the claims below. Accordingly, the specification and figures are to be regarded in an illustrative rather than a restrictive sense, and all such modifications are intended to be included within the scope of the present inventions. They can have different configurations than the examples illustrated in the drawings. Any benefits, advantages, or solutions to problems that are described herein with regard to specific embodiments are not intended to be construed as a critical, required, or essential feature or element of any or all the claims.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A method of using a back shaver handle, comprising:

(a) obtaining a back shaver handle comprising a grip end of a generally s-shaped elongated member having a body defining an inner side and an outer side, the outer side opposite the inner side, and a blade attachment at a blade end of the generally s-shaped elongated member, and a midway located between the grip end and the blade end, wherein the generally s-shaped elongated member is shaped with a body leverage surface on the inner side, the body leverage surface located between the blade end and the midway of the generally s-shaped elongated member, the blade end located on the inner side opposite the grip end, the blade attachment configured to hold a cartridge with a sharp blade in a way that allows the sharp blade to face away from the inner side of the generally s-shaped elongated member;

(b) gripping fingers of a hand of a user on the grip end with a thumb of the hand pointed away from the blade end of the generally s-shaped elongated member;

(c) pressing the body leverage surface against a forearm of the user when the grip end is gripped by the fingers of the hand by a same arm as the forearm of the user;

(d) positioning the generally s-shaped elongated member under an armpit of the user reaching the blade end under an armpit of the same arm of the user to leverage the blade attachment located on the inner side of the generally s-shaped elongated member against a torso backside of the user; and (e) leveraging the generally s-shaped elongated member using the forearm and the body leverage surface as a fulcrum relative to the grip end to press the blade end towards the torso backside of the user.

2. A method of using a back shaver handle according to claim 1, wherein the body leverage surface comprises a soft cushion attached thereto and wherein said step (c) of pressing comprises the step of (c)(1) pressing the soft cushion attached to the body leverage surface against the user's forearm arm.

3. A method of using a back shaver handle according to claim 2, wherein the soft cushion pressed in said step (c)(1) is curved such that it meshes with a curve of the body leverage surface on the inner side of the generally s-shaped elongated member near the midway between the grip end and the blade attachment.

4. A method of using a back shaver handle according to claim 2, wherein the soft cushion comprises a flexible sponge attached to the body leverage surface pressed against the user's forearm arm.

5. A method of using a back shaver handle according to claim 4, wherein the method further comprises the step of (g) reversing the fingers and the hand at the grip end and the generally s-shaped elongated member reaches the soft cushion against a torso backside of the user and the flexible sponge has characteristics capable of holding a skin care product for application to the torso backside of the user.

6. A method of using a back shaver handle according to claim 5, wherein the flexible sponge comprises strap, the method further comprises the step of (h) attaching the strap of the flexible sponge to the elongated member near the body leverage surface to adhere the sponge to the elongated member.

7. A method of using a back shaver handle according to claim 1, wherein the method further comprises the steps of:

(g) attaching a flexible sponge to the body leverage surface on the outer side of the generally s-shaped elongated member near the midway between the grip end and the blade attachment;

(h) absorbing a skin care product into the flexible sponge;

(i) reversing the fingers and the hand at the grip end;

(j) gripping with a thumb of the hand facing away from the blade end of the generally s-shaped elongated member;

(k) positioning the generally s-shaped elongated member under an armpit of the user reaching the blade end and the flexible sponge under an armpit of the same arm of the user to leverage the flexible sponge on the body leverage surface on the outer side of the generally s-shaped elongated member against a torso backside of the user; and (l) stroking the flexible sponge against the torso backside of the user.

8. A method of using a back shaver handle according to claim 1, further comprising the step of (g) attaching the blade attachment to a safety razor with a sharp edge of at least one sharp blade on the inner side of the elongated member facing against the torso backside of the user.

9. A method of using a back shaver handle according to claim 1, wherein the elongated member comprises a hinge and a finger release located near the hinge the inner surface of the elongated member, further comprising the step of (g) pressing the finger release.

10. A method of using a back shaver handle according to claim 1, wherein the elongated member comprises a hinge near the midway of the generally s-shaped elongated member, the midway located between the grip end and the blade attachment, further comprising the step of (g) folding the generally s-shaped elongated member at the hinge.

11. A method of using a back shaver handle according to claim 10, wherein the body leverage surface is located between the hinge and the grip end on the outer side of the elongated member.

12. A method of using a back shaver handle according to claim 10, wherein in said step (g) the elongated member is folded at the hinge back against itself for storage.

13. A method of using a back shaver handle according to claim 10, wherein in said step (g) the elongated member is folded at the hinge approximately 180 degrees to completely fold the elongated member back against itself for storage and reduce a length of the elongated member by approximately half.

14. A method of using a back shaver handle according to claim 1, wherein a cross-sectional shape of the elongated member has a shape that is substantially round or oval.

15. A method of using a back shaver handle according to claim 1, further comprising the steps of (f), attaching the blade attachment to a safety razor on the inner side of the elongated member, the safety razor comprising a sharp edge of at least one flexible sharp blade comprising a sharp edge facing against the torso backside of the user, and an outer comb comprising an inside edge, and an inner guard comprising an inner guard edge and a trailing opening inside of inner guard edge and a sharp blade and a leading opening inside an inside edge of outer comb and a sharp blade; and (f) stroking safety razor while attached to the blade end against the torso backside of the user.

16. A method of using a back shaver handle according to claim 15, wherein the sharp edge of the flexible sharp blade longitudinally bends relatively more parallel to a skin surface when the generally s-shaped elongated member presses the inside edge and the inner guard edge of the safety razor into the skin surface during shaving of hair.

17. A method of using a back shaver handle according to claim 1, wherein the generally s-shaped elongated member gripped in said step (a) is shaped with the body leverage surface as a convex shape on the inner side, the convex shape located between the blade receiving end and a midway, the midway located between the grip end and the blade attachment of the generally s-shaped elongated member.

* * * * *